US011367379B1

(12) United States Patent
Park et al.

(10) Patent No.: US 11,367,379 B1
(45) Date of Patent: Jun. 21, 2022

(54) DISPLAY DEVICE AND METHOD OF DRIVING DISPLAY DEVICE

(71) Applicant: Samsung Display Co., Ltd., Yongin-Si (KR)

(72) Inventors: Se Hyuk Park, Yongin-si (KR); Jae Keun Lim, Yongin-si (KR); Hong Soo Kim, Yongin-si (KR); Jin Young Roh, Yongin-si (KR); Hyo Jin Lee, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/409,865

(22) Filed: Aug. 24, 2021

(30) Foreign Application Priority Data

Mar. 15, 2021 (KR) ..... 10-2021-0033637

(51) Int. Cl.
*G09G 3/20* (2006.01)

(52) U.S. Cl.
CPC ... *G09G 3/2007* (2013.01); *G09G 2300/0842* (2013.01); *G09G 2310/027* (2013.01); *G09G 2310/0267* (2013.01); *G09G 2310/08* (2013.01); *G09G 2320/0247* (2013.01); *G09G 2330/021* (2013.01)

(58) Field of Classification Search
CPC ..... G09G 3/2007; G09G 2300/0842; G09G 2310/0267; G09G 2310/027; G09G 2310/08; G09G 2320/0247; G09G 2330/021
See application file for complete search history.

(56) References Cited

U.S. PATENT DOCUMENTS

| | | | | |
|---|---|---|---|---|
| 2015/0009109 | A1 | 1/2015 | Hwang et al. | |
| 2015/0070258 | A1* | 3/2015 | Miyake | G09G 3/3677 345/92 |
| 2016/0111051 | A1* | 4/2016 | Jeon | G09G 3/3674 345/204 |
| 2017/0116924 | A1* | 4/2017 | Zhang | G09G 3/3266 |
| 2018/0204502 | A1* | 7/2018 | Sung | G09G 3/2092 |
| 2019/0164499 | A1* | 5/2019 | Wu | G09G 3/3266 |
| 2019/0206325 | A1* | 7/2019 | Kim | G09G 3/3241 |
| 2020/0184904 | A1* | 6/2020 | Jung | G02B 27/017 |
| 2020/0273409 | A1* | 8/2020 | Hsieh | G09G 3/3233 |
| 2021/0027697 | A1 | 1/2021 | Yoon et al. | |

FOREIGN PATENT DOCUMENTS

| | | | |
|---|---|---|---|
| KR | 10-2019-0142791 | A | 12/2019 |
| KR | 10-2056676 | B1 | 12/2019 |

* cited by examiner

*Primary Examiner* — Andrew Sasinowski
(74) *Attorney, Agent, or Firm* — Innovation Counsel LLP

(57) ABSTRACT

A display device according to an embodiment of the disclosure includes a timing controller, a scan driver including a plurality of stages connected to a plurality of clock signal lines and generating a plurality of scan signals in response to the scan start signal, a data driver configured to generate a plurality of data signals based on the image data, and a pixel portion including a plurality of pixels. One stage in the scan driver transmits a carry signal to $2^{n\text{-}th}$ next stage. The timing controller selects any one of a normal frequency and low frequencies lower than the normal frequency as a driving frequency based on the input image data, and adjusts a clock duty of the plurality of clock signals so that a time required to output all of the plurality of scan signals during one frame is constant irrespective of the driving frequency.

23 Claims, 15 Drawing Sheets

DISPLAY DEVICE AND METHOD OF DRIVING DISPLAY DEVICE

CROSS-REFERENCE TO RELATED APPLICATION

The application claims priority to and the benefit of Korean Patent Application No. 10-2021-0033637, filed Mar. 15, 2021, the disclosure of which is hereby incorporated by reference for all purposes as if fully set forth herein in its entirety.

BACKGROUND

1. Field

The disclosure relates to a display device and a method of driving the display device.

2. Discussion

As an information technology is developed, importance of a display device that is a connection medium between a user and information is emphasized. In response to this, a use of a display device such as a liquid crystal display device and an organic light emitting display device is increasing.

The display device displays an image with a combination of light emission based on data voltages written to pixels. In order to select the pixels to which the data voltages are to be written, a scan driver is required. The scan driver may be classified into a progressive scanning method or an interlaced scanning method according to a driving method.

In the progressive scanning method, power consumption is high because the scan driver is required to sequentially output a scan signal to all scan lines in every frame. However, the progressive scanning method is suitable for video display because all scan lines are driven in every frame. On the other hand, in the interlaced scanning method, power consumption is low because the scan driver alternately drives odd-numbered scan lines and even-numbered scan lines every frame. However, the interlaced scanning method is suitable for still image display because only half of the scan lines are driven during a sub frame.

When the display device displays a still image, the display device may be driven at a low frequency. However, when the display device is driven at a low driving frequency, a flicker phenomenon in which flicker of a display image is visually recognized by a user may occur due to a leakage characteristic of a display panel, or the like.

SUMMARY

A technical object to be solved by the disclosure is to provide a display device capable of driving at a low frequency while preventing a flicker phenomenon, and a method of driving the display device.

Another technical object to be solved by the disclosure is to provide a display device capable of reducing power consumption and a method of driving the display device.

However, the object of the disclosure is not limited to the above-described objects, and may be variously extended without departing from the spirit and scope of the disclosure.

In order to solve the above-described object, according to an embodiment of the disclosure, a display device includes a timing controller configured to receive input image data and output a plurality of clock signals, a scan start signal, and image data, a scan driver including a plurality of stages connected to a plurality of clock signal lines to which the plurality of clock signals are provided and generating a plurality of scan signals in response to the scan start signal, a data driver configured to generate a plurality of data signals based on the image data, and a pixel portion including a plurality of pixels, each of the plurality of pixels emitting light with luminance corresponding to a respective data signal in response to a respective scan signal.

One stage in the scan driver transmits a carry signal to $2^n$-th next stage (n is a natural number greater than or equal to 2). The timing controller selects any one of a normal frequency and low frequencies lower than the normal frequency as a driving frequency based on the input image data, and adjusts a clock duty of the plurality of clock signals so that a time required to output all of the plurality of scan signals during one frame is constant irrespective of the driving frequency.

When the unit of the stages to which the carry signal is transmitted is $2^n$, the number of clock signal lines may be $2^{n+1}$.

When the normal frequency is F [Hz], the low frequencies may include a frequency that satisfies Equation 1 below.

$$\text{Low frequency}=F/2m\ [\text{Hz}]\ (\text{where } m \text{ is a natural number of } 1\leq m\leq n). \quad \text{[Equation 1]}$$

When grayscale values of the input image data corresponding to each of consecutive frames are substantially the same, the timing controller may select any one of the low frequencies as the driving frequency, and when the grayscale values of the input image data corresponding to each of the consecutive frames are substantially different, the timing controller may select the normal frequency as the driving frequency.

When the driving frequency decreases by ½ times, the clock duty may increase by 2 times.

When the number of the clock signal lines is eight, the driving frequency may include the normal frequency, a first low frequency, and a second low frequency lower than the first low frequency.

When the driving frequency is selected as the normal frequency, the plurality of stages may sequentially output the plurality of scan signals during one frame.

When the driving frequency is selected as the first low frequency, the plurality of stages may output an odd number of scan signals corresponding to a (2k−1)-th (k is a natural number greater than or equal to 1) pixel row among the plurality of scan signals during a first sub frame, and output an even number of scan signals corresponding to a 2k-th (k is a natural number greater than or equal to 1) pixel row among the plurality of scan signals during a second sub frame.

Each of the first and second sub frames may include a first data blank period in which the plurality of clock signal have a turn-off level.

When the driving frequency is selected as the second low frequency, the plurality of stages may output scan signals of a first group corresponding to a (4k−3)-th (k is a natural number greater than 1) pixel row among the plurality of scan signals during a (1-1)-th sub frame, output scan signals of a second group corresponding to a (4k−2)-th (k is a natural number greater than 1) pixel row among the plurality of scan signals during a (2-1)-th sub frame, output scan signals of a third group corresponding to a (4k−1)-th (k is a natural number greater than 1) pixel row among the plurality of scan signals during a third sub frame, and output scan signals of a fourth group corresponding to a 4k-th (k is a natural number greater than 1) pixel row among the plurality of scan signals during a fourth sub frame.

Each of the (1-1)-th sub frame, the (2-1)-th sub frame, the third sub frame, and the fourth sub frame may include a second data blank period in which the plurality of clock signal have the turn-off level.

A length of the second data blank period may be longer than a length of the first data blank period.

According to an embodiment of the disclosure, a method of driving a display device including a timing controller configured to receive input image data and output a plurality of clock signals, a scan start signal, and image data, a scan driver including a plurality of stages connected to a plurality of clock signal lines to which the plurality of clock signals are provided and generating a plurality of scan signals in response to the scan start signal, a data driver configured to generate a plurality of data signals based on the image data, and a pixel portion including a plurality of pixels, each of the plurality of pixels emitting light with luminance corresponding to a respective data signal in response to a respective scan signal. The method includes selecting any one of a normal frequency and low frequencies lower than the normal frequency as a driving frequency based on the input image data, and adjusting a clock duty of the plurality of clock signals so that a time required to output all of the plurality of scan signals during one frame is constant irrespective of the driving frequency.

One stage in the scan driver may transmit a carry signal to $2^n$-th stage (n is a natural number greater than or equal to 2), and the number of clock signal lines may be $2^{n+1}$.

Selecting the driving frequency may include selecting any one of the low frequencies as the driving frequency when gray scale values of the input image data corresponding to each of consecutive frames are substantially the same, and selecting the normal frequency as the driving frequency when the grayscale values of the input image data corresponding to each of the consecutive frames are substantially different.

Adjusting the clock duty may include increasing the clock duty by 2 times when the driving frequency decreases by ½ times.

When the number of the plurality of clock signal lines is eight, the driving frequency may include the normal frequency, a first low frequency, and a second low frequency lower than the first low frequency.

When the driving frequency is selected as the normal frequency, the plurality of stages may sequentially output the plurality of scan signals during one frame.

When the driving frequency is selected as the first low frequency, the plurality of stages may output an odd number of scan signals corresponding to a (2k−1)-th (k is a natural number greater than or equal to 1) pixel row among the plurality of scan signals during a first sub frame, and output an even number of scan signals corresponding to a 2k-th (k is a natural number greater than or equal to 1) pixel row among the plurality of scan signals during a second sub frame.

Each of the first and second sub frames may include a first data blank period in which the plurality of clock signal have a turn-off level.

When the driving frequency is selected as the second low frequency, the plurality of stages may output scan signals of a first group corresponding to a (4k−3)-th (k is a natural number greater than 1) pixel row among the plurality of scan signals during a (1-1)-th sub frame, output scan signals of a second group corresponding to a (4k−2)-th (k is a natural number greater than 1) pixel row among the plurality of scan signals during a (2-1)-th sub frame, output scan signals of a third group corresponding to a (4k−1)-th (k is a natural number greater than 1) pixel row among the plurality of scan signals during a third sub frame, and output scan signals of a fourth group corresponding to a 4k-th (k is a natural number greater than 1) pixel row among the plurality of scan signals during a fourth sub frame.

Each of the (1-1)-th sub frame, the (2-1)-th sub frame, the third sub frame, and the fourth sub frame may include a second data blank period in which the plurality of clock signals have the turn-off level.

A length of the second data blank period may be longer than a length of the first data blank period.

The display device and the method of driving the display device according to the disclosure may reduce a driving frequency by increasing the number of clock signal lines and an interval (or the number of carry stages) of stages through which a carry signal is transmitted.

In addition, the display device and the method of driving the display device according to the disclosure may reduce power consumption by inserting a period in which a clock signal is not applied (or a data blank period) between sub frames.

However, an effect of the disclosure is not limited to the above-described effect, and may be variously extended without departing from the spirit and scope of the disclosure.

BRIEF DESCRIPTION OF THE DRAWINGS

The above and other features of the disclosure will become more apparent by describing in further detail embodiments thereof with reference to the accompanying drawings, in which.

DETAILED DESCRIPTION OF THE ILLUSTRATED EMBODIMENTS

Figure 1:
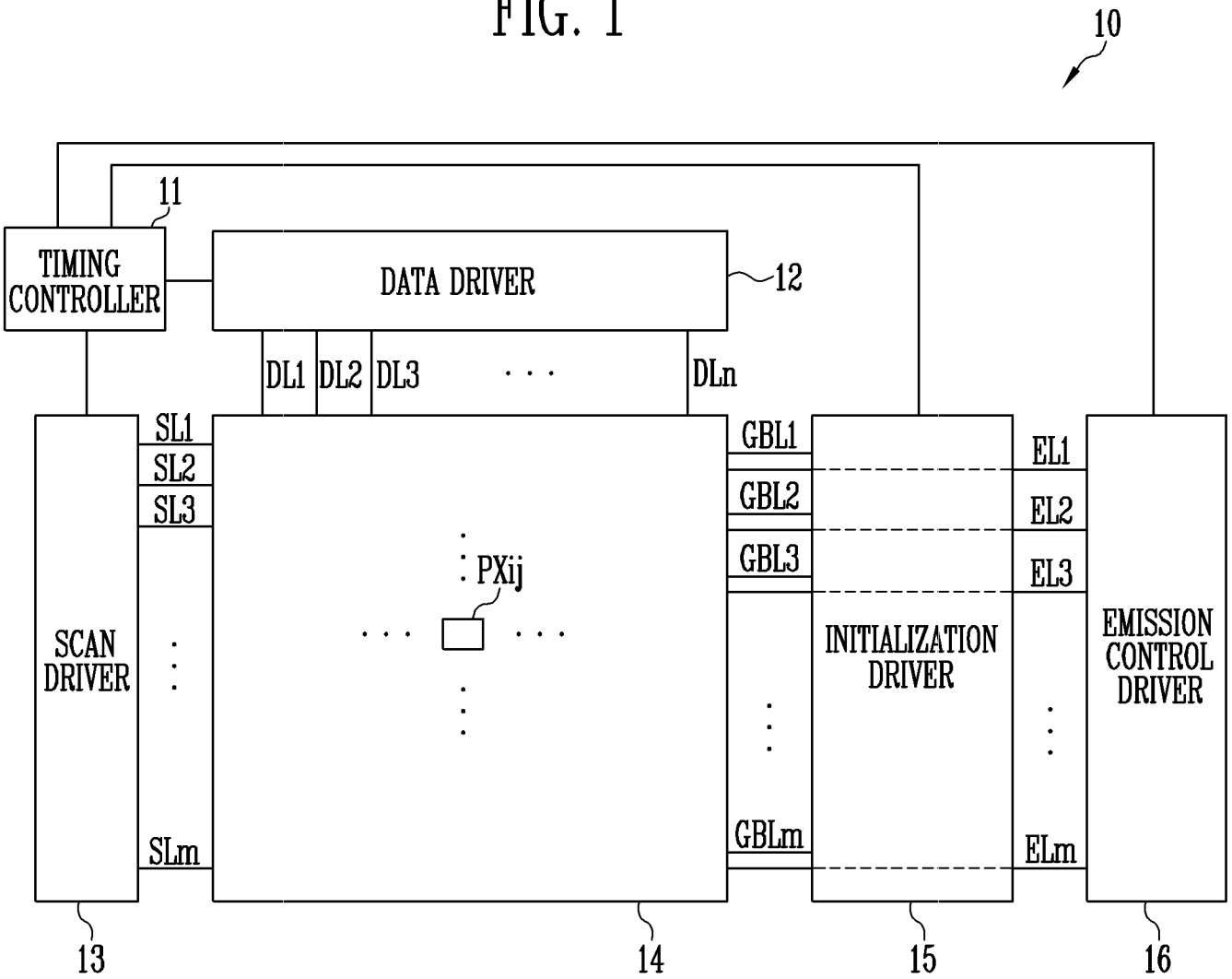
FIG. 1 is a diagram illustrating a display device according to an embodiment of the disclosure.

Hereinafter, various embodiments of the disclosure will be described in detail with reference to the accompanying drawings so that those skilled in the art may easily carry out the disclosure. The disclosure may be implemented in various different forms and is not limited to the embodiments described herein.

In order to clearly describe the disclosure, parts that are not related to the description are omitted, and the same or similar components are denoted by the same reference numerals throughout the specification. Therefore, the above-described reference numerals may be used in other drawings.

In addition, an expression "is the same" in the description may mean "is substantially the same". That is, the expression "is the same" may be the same enough for those of ordinary skill to understand that it is the same. Other expressions may also be expressions in which "substantially" is omitted.

FIG. 1 is a diagram illustrating a display device according to an embodiment of the disclosure.

Referring to FIG. 1, the display device 10 according to an embodiment of the disclosure may include a timing controller 11, a data driver 12, a scan driver 13, a pixel portion 14, an initialization driver 15, and an emission control driver 16.

The timing controller 11 may receive an external input signal from an external processor. The external input signal may include a vertical synchronization signal, a horizontal synchronization signal, a data enable signal, RGB data (or input image data), and the like. The vertical synchronization signal may include a plurality of pulses, and may indicate that a previous frame period is ended and a current frame period is started based on a time point when each of the pulses is generated. An interval between adjacent pulses of the vertical synchronization signal may correspond to one frame period. The horizontal synchronization signal may include a plurality of pulses, and may indicate that a previous horizontal period is ended and a new horizontal period is started based on a time point when each of the pulses is generated. An interval between adjacent pulses of the horizontal synchronization signal may correspond to one horizontal period. The data enable signal may indicate that the RGB data is supplied in the horizontal period. The RGB data may be supplied in a pixel row unit in the horizontal periods in response to the data enable signal. The RGB data corresponding to one frame may be referred to as one input image.

When grayscale values of consecutive input images are substantially the same, the timing controller 11 may determine the consecutive input images as a still image. When the grayscale values of the consecutive input images are substantially different, the timing controller 11 may determine the consecutive input images as a moving picture.

The data driver 12 may provide data voltages corresponding to grayscales of the input image to pixels. For example, the data driver 12 may sample the grayscales using a clock signal and apply the data voltages corresponding to the grayscales to data lines DL1 to DLn one row at a time, where n may be an integer greater than 0.

The scan driver 13 may receive a clock signal, a scan start signal, and the like from the timing controller 11, to generate scan signals to be provided to scan lines SL1, SL2, SL3, . . . , and SLm, where m may be an integer greater than 0.

The pixel portion 14 includes the pixels. Each pixel PXij may be connected to corresponding data line and scan line, where i and j may be integers greater than 0. For example, the pixel PXij may mean a pixel in which a scan transistor is connected to an i-th scan line and a j-th data line.

The initialization driver 15 may supply initialization signals to initialization lines GBL1 to GBLm in response to control of the timing controller 11. For example, the initialization driver 15 may sequentially supply the initialization signal to the initialization lines GBL1 to GBLm.

The emission control driver 16 may supply an emission control signals to emission control lines EL1 to ELm under the control of the timing controller 11. For example, the emission control driver 16 may sequentially supply the emission control signals to the emission control lines EL1 to ELm. According to an embodiment, the emission control signals may be set to have a width wider than that of the scan signals. For example, one emission control signal may overlap at least two scan signals.

Figure 2:
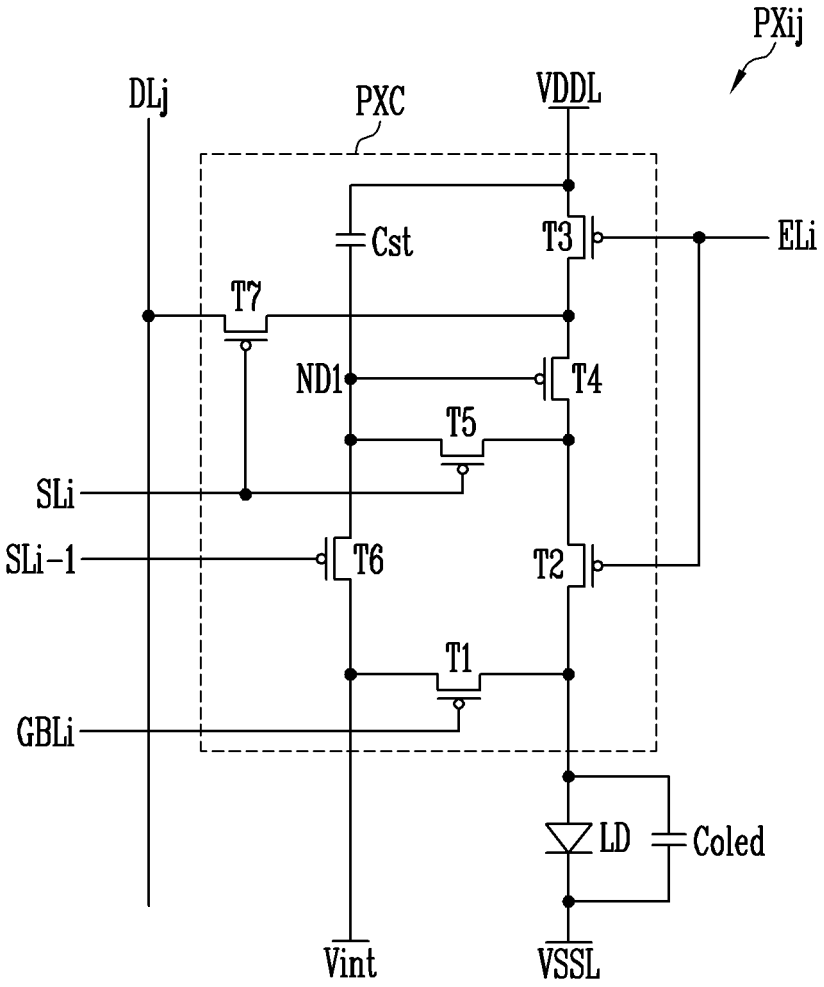
FIG. 2 is a diagram illustrating a pixel according to an embodiment of the disclosure.

FIG. 2 is a diagram illustrating a pixel according to an embodiment of the disclosure. In FIG. 2, the pixel PXij connected to the i-th scan line SLi and the j-th data line DLj is shown.

Referring to FIG. 2, the pixel PXij according to an embodiment of the disclosure may include a light emitting diode LD, first to seventh transistors T1 to T7, and a storage capacitor Cst.

An anode electrode of the light emitting diode LD is connected to a pixel circuit PXC, and a cathode electrode is connected to a second pixel power line VSSL. The light emitting diode LD may generate light of a predetermined luminance in response to an amount of a current supplied from the pixel circuit PXC.

The pixel circuit PXC may control an amount of a current flowing from a first pixel power line VDDL to the second pixel power line VSSL via the light emitting diode LD in response to the data signal. For example, the pixel circuit PXC may initialize a gate electrode of the fourth transistor T4 (or a driving transistor) when the scan signal is supplied to an (i−1)-th scan line SLi−1, and store the data signal from the m-th data line DLm when the scan signal is supplied to the i-th scan line SLi. In addition, the pixel circuit PXC may control an amount of a current supplied to the light emitting diode LD in response to the data signal when supply of the emission control signal to an i-th emission control line ELi is stopped.

Such a pixel circuit PXC may be implemented as various types of circuits that are currently known. In addition, the first pixel power line VDDL may be set to a voltage higher than that of the second pixel power line VSSL so that the current flows to the light emitting diode LD.

The first transistor T1 is connected between an initialization voltage line that supplies an initialization voltage Vint and the anode electrode of the light emitting diode LD. In addition, a gate electrode of the first transistor T1 may be connected to an i-th initialization line GBLi (or a control line). The first transistor T1 may be turned on when an initialization signal is supplied to the i-th initialization line GB Li, to supply the initialization voltage Vint to the anode electrode of the light emitting diode LD. Here, the initialization voltage Vint may be set to a voltage lower than that of the data signal.

The second transistor T2 may be connected between the fourth transistor T4 and the anode electrode of the light emitting diode LD. In addition, a gate electrode of the second transistor T2 may be connected to the i-th emission control line ELi. The second transistor T2 may be turned off when the emission control signal having a high level is supplied to the i-th emission control line ELi and may be turned on in other cases.

The third transistor T3 may be connected between the first pixel power line VDDL and the fourth transistor T4. In addition, a gate electrode of the third transistor T3 may be connected to the i-th emission control line ELi. The third transistor T3 may be turned off when the emission control signal having a high level is supplied to the i-th emission control line ELi and may be turned on in other cases.

A first electrode of the fourth transistor T4 (the driving transistor) is connected to the first pixel power line VDDL via the third transistor T3, and a second electrode is connected to the anode electrode of the light emitting diode LD via the second transistor T2. In addition, a gate electrode of the fourth transistor T4 is connected to a first node ND1. The fourth transistor T4 may control the amount of the current flowing from the first pixel power line VDDL to the second pixel power line VSSL via the light emitting diode LD in response to a voltage of the first node ND1.

The fifth transistor T5 is connected between the second electrode of the fourth transistor T4 and the first node ND1. In addition, a gate electrode of the fifth transistor T5 is connected to the i-th scan line SLi. The fifth transistor T5 is turned on when the scan signal is supplied to the i-th scan line SLi to electrically connect the second electrode of the fourth transistor T4 and the first node ND1. Therefore, when the fifth transistor T5 is turned on, the fourth transistor T4 is diode connected.

The sixth transistor T6 is connected between the first node ND1 and the initialization voltage line that supplies the initialization voltage Vint. In addition, a gate electrode of the sixth transistor T6 is connected to the (i−1)-th scan line SLi−1. The sixth transistor T6 is turned on when the scan signal is supplied to the (i−1)-th scan line SLi−1 to supply the initialization voltage Vint to the first node ND1.

The seventh transistor T7 is connected between the m-th data line DLm and the first electrode of the fourth transistor T4. In addition, a gate electrode of the seventh transistor T7 is connected to the i-th scan line SLi. The seventh transistor T7 is turned on when the scan signal is supplied to the i-th scan line SLi to electrically connect the m-th data line DLm and the first electrode of the fourth transistor T4.

The storage capacitor Cst is connected between the first pixel power line VDDL and the first node ND1. The storage capacitor Cst may store a voltage corresponding to a data signal plus a threshold voltage of the fourth transistor T4.

Figure 3:
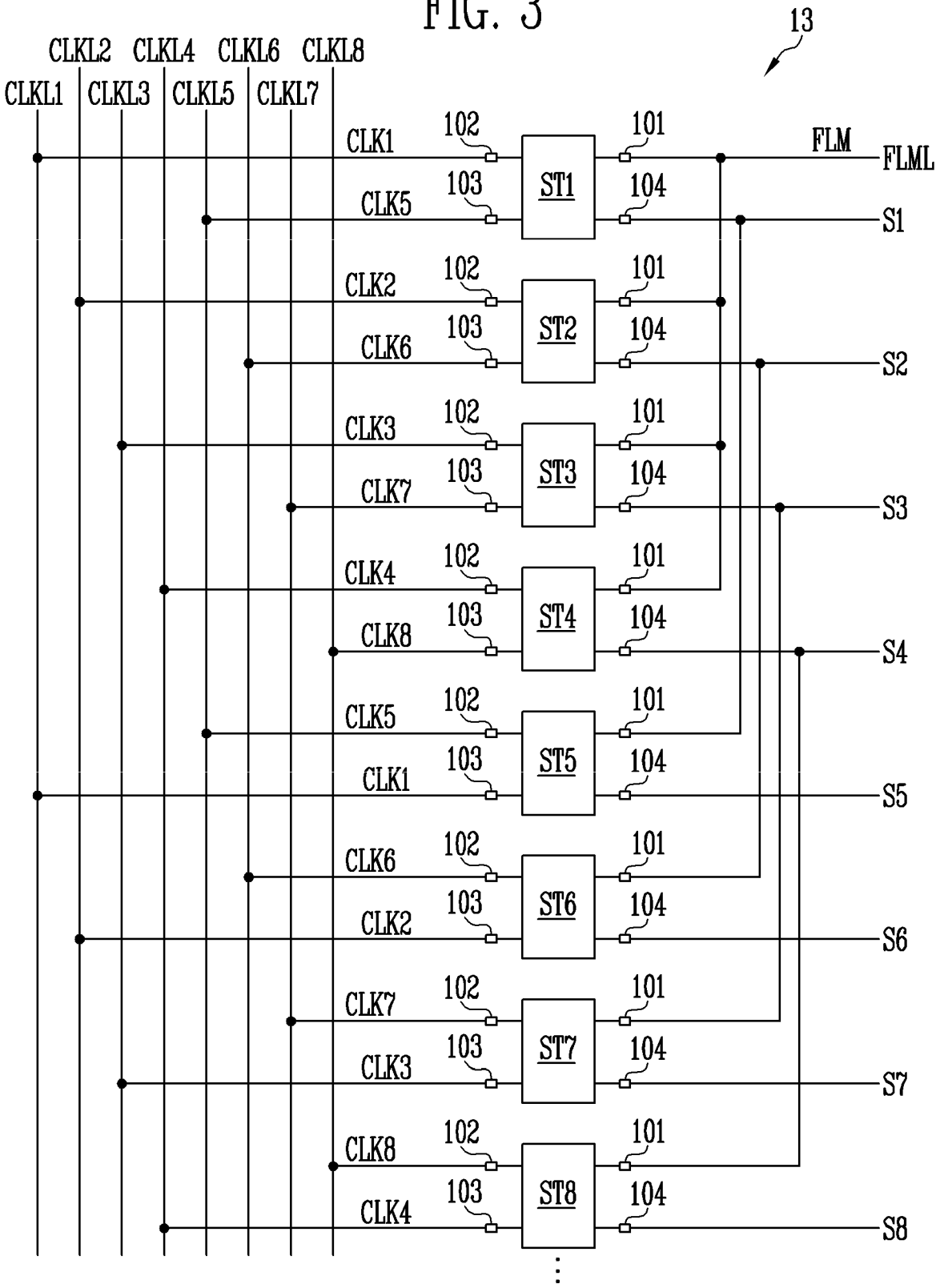
FIG. 3 is a diagram illustrating an embodiment of a scan driver shown in FIG. 1.

FIG. 3 is a diagram illustrating an embodiment of the scan driver shown in FIG. 1. In FIG. 3, eight stages are shown for convenience of description.

Here, when a carry signal is transmitted from a current stage to one of next stages, the number of carry stages may be determined according to a number of stages from the current stage to the one of next stages. For example, when a carry signal (or scan signal) output from an output terminal 104 of a first stage ST1 is transmitted to a first input terminal 101 of a fifth stage ST5, the number of carry stages is 4 because the fifth stage ST5 corresponds to a fourth stage from the first stage ST1.

Referring to FIG. 3, according to an embodiment of the disclosure, one stage in the scan driver 13 may transmit the carry signal to a first input terminal 101 of $2^n$-th next stages (where p is a natural number greater than or equal to 2), and may include the plurality of stages ST1 to ST8 outputting the scan signals, and a plurality of clock signal lines CLKL1 to CLKL8 supplying clock signals CLK1 to CLK8 to each of the stages ST1 to ST8.

The number of clock signal lines CLKL1 to CLKL8 may increase corresponding to the number of carry stages.

When the number of carry stages are $2^n$, the number of the clock signal lines may be, $2^{n+1}$. For example, when the carry signal is transmitted to a fourth next stage (that is, p=2) from the stage that transmits the carry signal, the number of clock signal lines may be eight (CLKL1 to CLKL8).

As shown in FIG. 3, the scan driver 13 according to an embodiment of the disclosure may include the plurality of stages ST1 to ST8. Each of the stages ST1 to ST8 may be connected to any one of the scan lines SL1 to SL8 and may be driven in response to the clock signals CLK1 to CLK8 provided from the first to eighth clock signal lines CLKL1 to CLKL8. The stages ST1 to ST8 may have the same circuit configuration.

Each of the stages ST1 to ST8 may include the first input terminal 101, a second input terminal 102, a third input terminal 103, and the output terminal 104.

The first input terminal 101 of the stages ST1 to ST8 may receive an output signal (that is, the scan signal) output from the output terminal 104 of a 2n-th previous stage as the carry signal. For example, the first input terminal 101 of the fifth stage ST5 may receive the output signal output from the output terminal 104 of the first stage ST1 which is the fourth previous stage (when p is 2) from the fifth stage ST5 as the carry signal.

The input terminals 101 of the first stage to the $2^n$-th stage may be commonly connected to a scan start signal line FLML. For example, when the number of carry stages is 4 (p=2), the first input terminals 101 of the first to fourth stages ST1 to ST4 may be commonly connected to the scan start signal line FLML and may receive a scan start signal FLM simultaneously.

According to an embodiment of the disclosure, the second input terminal 102 of a (4k−3)-th (k is a natural number) stage may alternately receive the first clock signal CLK1 and the fifth clock signal CLK5, and the third input terminal 103 may alternately receive the fifth clock signal CLK5 and the first clock signal CLK1. The first clock signal CLK1 and the fifth clock signal CLK5 may have the same period and may have different phases as disclosed in FIG. 5. Similarly, the second input terminal 102 of a (4k−2)-th stage may alternately receive the second clock signal CLK2 and the sixth clock signal CLK6, and the third input terminal 103 may alternately receive the sixth clock signal CLK6 and the second clock signal CLK2. The second clock signal CLK2 and the sixth clock signal CLK6 may have the same period and may have different phases. The second input terminal 102 of a (4k−1)-th stage may alternately receive the third clock signal CLK3 and the seventh clock signal CLK7, and the third input terminal 103 may alternately receive the seventh clock signal CLK7 and the third clock signal CLK3. The third clock signal CLK3 and the seventh clock signal CLK7 may have the same period and may have different phases. In addition, the second input terminal 102 of a 4k-th stage may alternately receive the fourth clock signal CLK4 and the eighth clock signal CLK8, and the third input terminal 103 may alternately receive the eighth clock signal CLK8 and the fourth clock signal CLK4. The fourth clock signal CLK4 and the eighth clock signal CLK8 have the same period and may have different phases.

Figure 6:
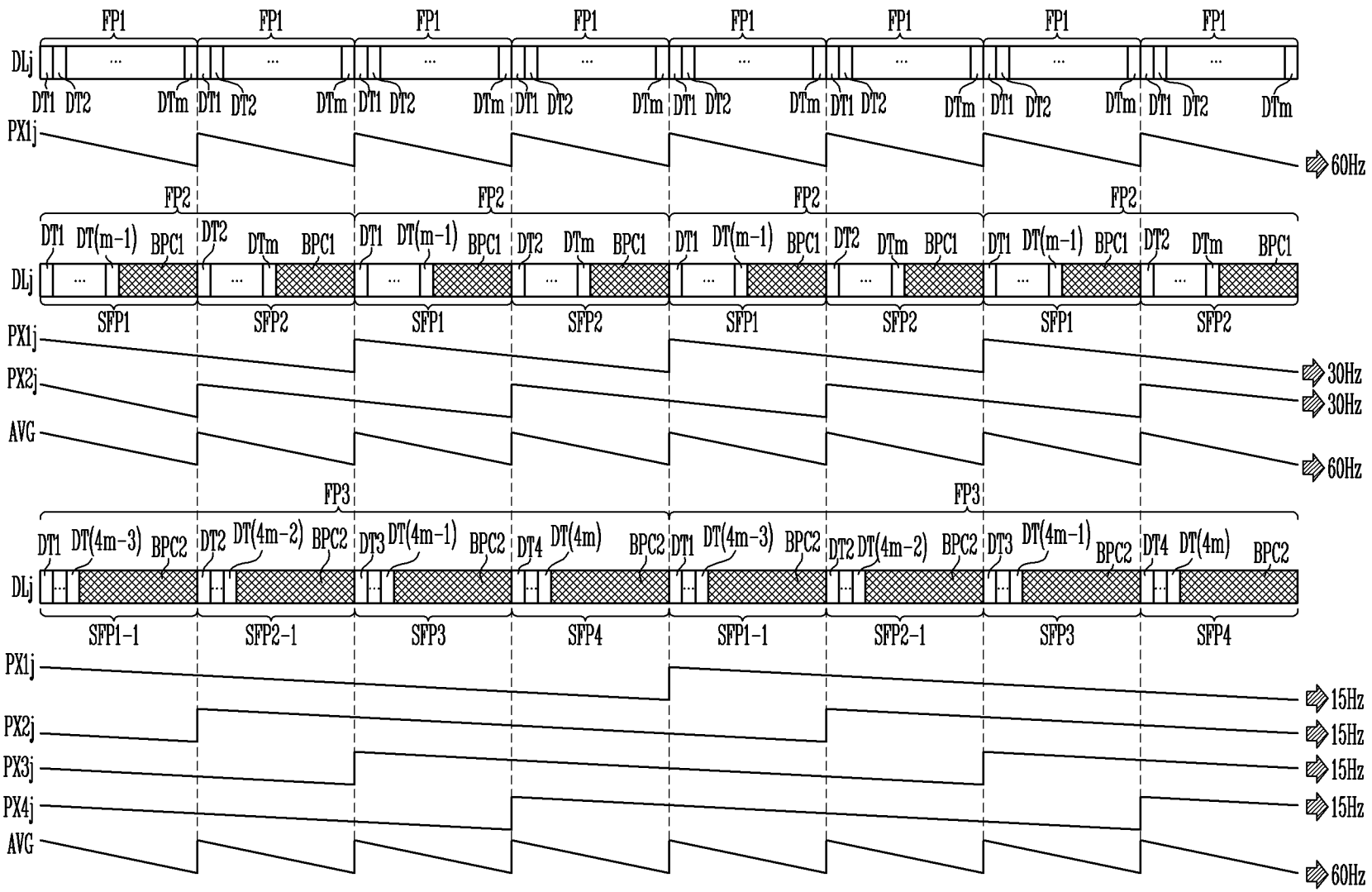
FIGS. 6, 7, 8, 9, 10, 11, 12, 13, 14 and 15 are diagrams illustrating a first frame period, a second frame period, and a third frame period according to an embodiment of the disclosure.

Meanwhile, according to an embodiment of the disclosure, a period (or a clock duty) of the clock signals CLK1 to CLK8 may be adjusted so that a time required to output all of scan signals S1 to S8 during one frame is constant irrespective of a driving frequency of the scan signals S1 to S8 (or a driving frequency of the display device 10, refer to FIG. 6). For example, the clock duty of the clock signals CLK1 to CLK8 may increase by 2 times when the driving frequency decreases by ½ times which will be described later in detail with reference to FIGS. 6 and 15.

Figure 4:
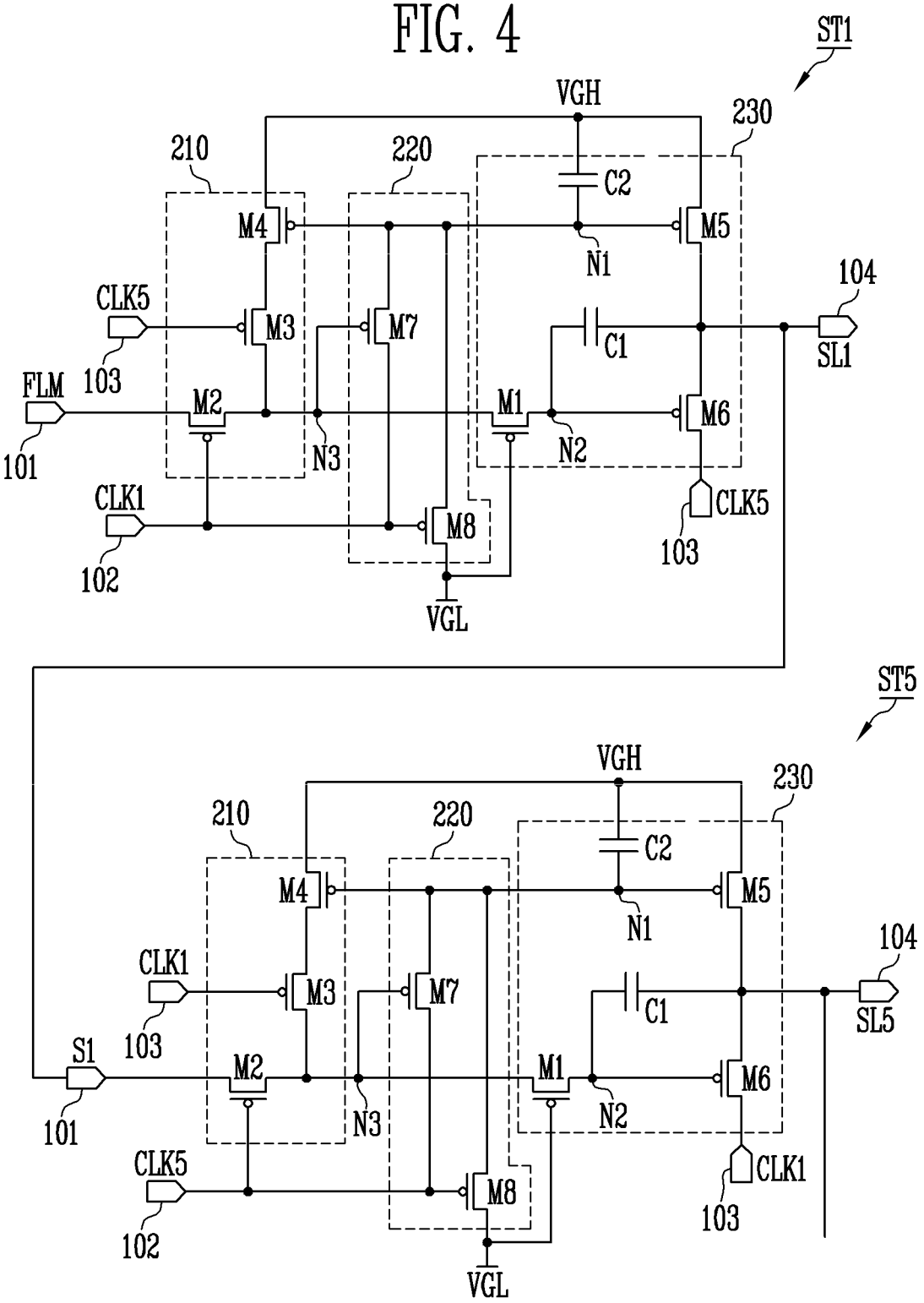
FIG. 4 is a circuit diagram illustrating an embodiment of a stage shown in FIG. 3.

FIG. 4 is a circuit diagram illustrating an embodiment of the stage shown in FIG. 3. In FIG. 4, for convenience of description, the first stage ST1 and the fifth stage ST5 of the (4k−3)-th stage is shown. The (4k−2)-th stage, the (4k−1)-th stage, and the 4k-th stage may also have the same configuration as the (4k−3)-th stage. Meanwhile, in FIG. 4, transistors are formed of PMOS, but the disclosure is not limited thereto. For example, the transistors may be formed of NMOS.

Referring to FIG. 4, the first stage ST1 according to an embodiment of the disclosure may include a first driver 210, a second driver 220, and an output unit 230.

The output unit 230 may control a voltage supplied to the output terminal 104 in response to voltages applied to a first node N1 and a second node N2. To this end, the output unit 230 may include a first transistor M1, a fifth transistor M5, a sixth transistor M6, a first capacitor C1, and a second capacitor C2. The output terminal 104 of the first stage ST1 may be connected to the first scan line SL1 and the output terminal 104 of the fifth stage ST5 may be connected to the fifth scan line SL5.

The first transistor M1 may be connected between a third node N3 and the second node N2, and a gate electrode of the first transistor M1 may be connected to second power VGL. The first transistor M1 may maintain an electrical connection between the third node N3 and the second node N2 while maintaining a turn-on state. Additionally, the first transistor M1 may limit a voltage drop of the third node N3. In other words, even though the voltage of the second node N2 drops to a voltage lower than that of the second power VGL, a voltage of the third node N3 maintains a voltage obtained by subtracting a threshold voltage of the first transistor M1 from the second power VGL.

The fifth transistor M5 may be connected between first power VGH and the output terminal 104, and a gate electrode of the fifth transistor M5 may be connected to the first node N1. The fifth transistor M5 may control a connection between the first power VGH and the output terminal 104 in response to the voltage applied to the first node N1. Here, the first power VGH may be set to a gate off voltage, for example, a high level voltage.

The sixth transistor M6 may be connected between the output terminal 104 and the third input terminal 103, and a gate electrode of the sixth transistor M6 may be connected to the second node N2. The sixth transistor M6 may control a connection between the output terminal 104 and the third input terminal 103 in response to the voltage applied to the second node N2.

The first capacitor C1 may be connected between the second node N2 and the output terminal 104. The first capacitor C1 may charge a voltage corresponding to turn-on and turn-off of the sixth transistor M6.

The second capacitor C2 may be connected between the first node N1 and the first power VGH. The second capacitor C2 may charge the voltage applied to the first node N1.

The first driver 210 may control the voltage of the third node N3 in response to signals supplied to the first to third input terminals 101 to 103. To this end, the first driver 210 may include second to fourth transistors M2 to M4.

The second transistor M2 may be connected between the first input terminal 101 and the third node N3, and a gate electrode of the second transistor M2 may be connected to the second input terminal 102. The second transistor M2 may control a connection between the first input terminal 101 and the third node N3 in response to a signal supplied to the second input terminal 102.

The third transistor M3 and the fourth transistor M4 may be connected in series between the third node N3 and the first power VGH. Actually, the third transistor M3 may be connected between the fourth transistor M4 and the third node N3, and a gate electrode of the third transistor M3 may be connected to the third input terminal 103. The third transistor M3 may control a connection between the fourth transistor M4 and the third node N3 in response to a signal supplied to the third input terminal 103.

The fourth transistor M4 may be connected between the third transistor M3 and the first power VGH, and a gate electrode of the fourth transistor M4 may be connected to the first node N1. The fourth transistor M4 may control a connection between the third transistor M3 and the first power VGH in response to the voltage of the first node N1.

The second driver 220 may control the voltage of the first node N1 in response to the voltage of the second input terminal 102 and the third node N3. To this end, the second driver 220 may include a seventh transistor M7 and an eighth transistor M8.

The seventh transistor M7 may be connected between the first node N1 and the second input terminal 102, and a gate electrode of the seventh transistor M7 may be connected to the third node N3. The seventh transistor M7 may control a connection between the first node N1 and the second input terminal 102 in response to the voltage of the third node N3.

The eighth transistor M8 may be connected between the first node N1 and the second power VGL, and a gate electrode may be connected to the second input terminal 102. The eighth transistor M8 may control a connection between the first node N1 and the second power VGL in response to a signal of the second input terminal 102. Here, the second power VGL may be set to a gate on voltage, for example, a low level voltage.

Figure 5:
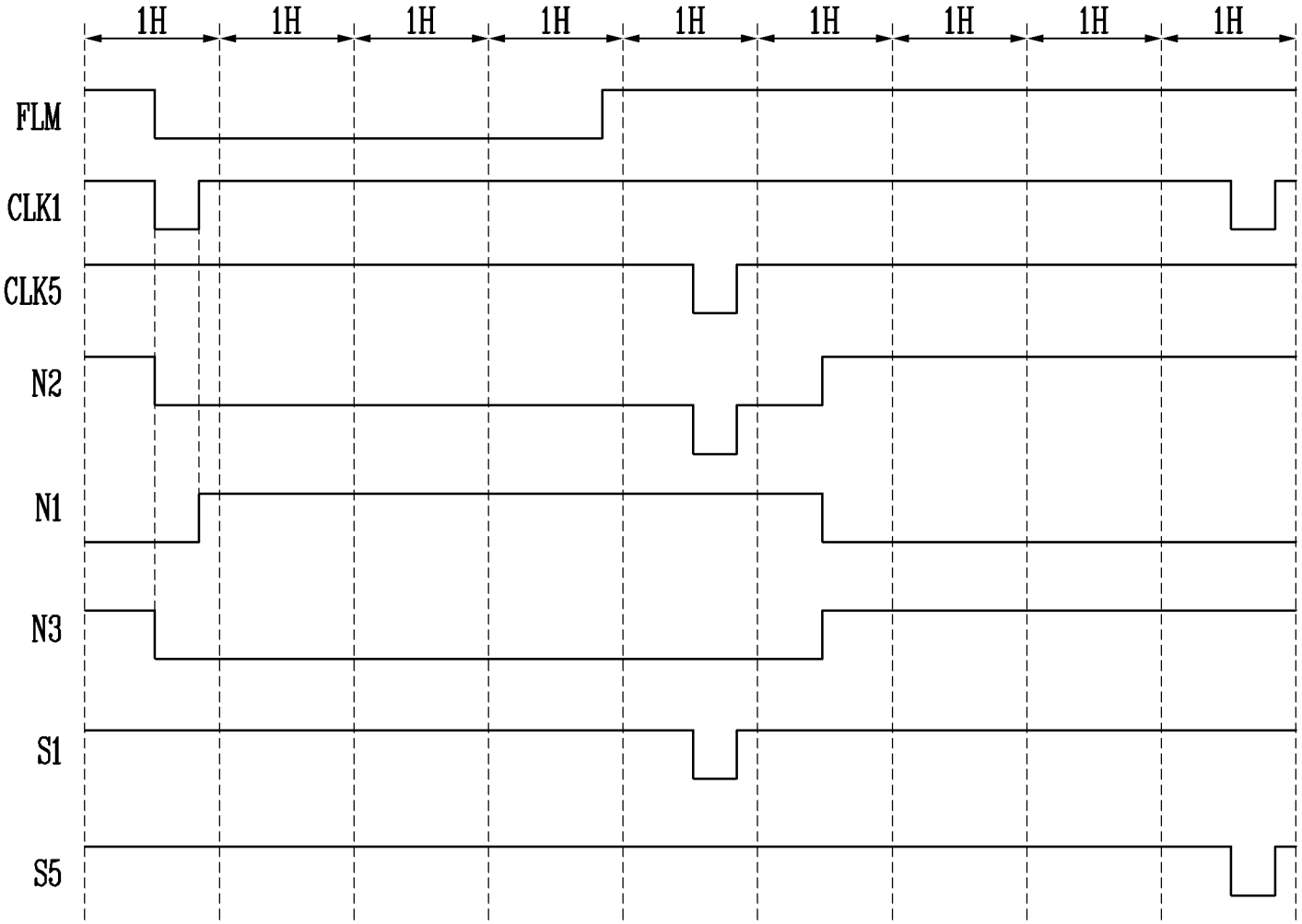
FIG. 5 is a waveform diagram illustrating a driving method of a stage circuit shown in FIG. 4 according to an embodiment.

FIG. 5 is a waveform diagram illustrating a driving method of the stage circuit shown in FIG. 4 according to an embodiment. In FIG. 5, for convenience of description, an operation is described using the first stage ST1 and the fifth stage ST5 of the (4k−3)-th stage.

Referring to FIGS. 3 and 5, the first clock signal CLK1 may be applied to the first clock signal line CLKL1, the second clock signal CLK2 may be applied to the second clock signal line CLKL2, the third clock signal CLK3 may be applied to the third clock signal line CLKL3, the fourth clock signal CLK4 may be applied to the fourth clock signal line CLKL4, the fifth clock signal CLK5 may be applied to the fifth clock signal line CLKL5, the sixth clock signal CLK6 may be applied to the sixth clock signal line CLKL6, the seventh clock signal CLK7 may be applied to the seventh clock signal line CLKL7, and the eighth clock signal CLK8 may be applied the eighth clock signal line CLKL8.

The first to eighth clock signals CLK1 to CLK8 may be signals having the same frequency and different phases. For example, the first clock signal CLK1 of a turn-on level (logic low level), the second clock signal CLK2 of the turn-on level, the third clock signal CLK3 of the turn-on level, a fourth clock signal CLK4 of the turn-on level, the fifth clock signal CLK5 of the turn-on level, the sixth clock signal CLK6 of the turn-on level, the seventh clock signal CLK7 of the turn-on level, the eighth clock signal CLK8 of the turn-on level may be sequentially supplied to respective stages ST1 to ST8.

Hereinafter the operation of the scan driver 13 will be described. First, the scan start signal FLM which is synchronized with the first clock signal CLK1 may be supplied to the second input terminal 102.

When the first clock signal CLK1 is supplied, the second transistor M2 and the eighth transistor M8 are turned on. When the second transistor M2 is turned on, the first input terminal 101 and the third node N3 are electrically connected. Here, since the first transistor M1 is always set in a turn-on state, the second node N2 maintains an electrical connection with the third node N3.

When the first input terminal 101 and the third node N3 are electrically connected, the third node N3 and the second node N2 are set to a low voltage by the scan start signal FLM supplied to the first input terminal 101. When the third node N3 and the second node N2 are set to the low voltage, the sixth transistor M6 and the seventh transistor M7 are turned on.

When the sixth transistor M6 is turned on, the third input terminal 103 and the output terminal 104 are electrically connected. Here, the third input terminal 103 is set to a high voltage (that is, the fifth clock signal CLK5 is not supplied), and thus a high voltage is also output to the output terminal 104. When the seventh transistor M7 is turned on, the second input terminal 102 and the first node N1 are electrically connected. Then, a voltage of the first clock signal CLK1 supplied to the second input terminal 102 having a low voltage is supplied to the first node N1.

Additionally, when the first clock signal CLK1 is supplied, the eighth transistor M8 is turned on. When the eighth transistor M8 is turned on, a voltage of the second power VGL is supplied to the first node N1. Here, the voltage of the second power VGL is set to the same (or similar) voltage as the first clock signal CLK1, and thus the first node N1 stably maintains the low voltage.

When the first node N1 is set to the low voltage, the fourth transistor M4 and the fifth transistor M5 are turned on. When the fourth transistor M4 is turned on, the first power VGH and the third transistor M3 are electrically connected. Here, since the third transistor M3 is set to a turn-off state, even though the fourth transistor M4 is turned on, the third node N3 stably maintains a low voltage. When the fifth transistor M5 is turned on, a voltage of the first power VGH is supplied to the output terminal 104. Here, the voltage of the first power VGH is set to the same voltage as the high voltage supplied to the third input terminal 103, and thus the output terminal 104 stably maintains the high voltage.

Thereafter, the supply of the scan start signal FLM and the first clock signal CLK1 is stopped. When the supply of the first clock signal CLK1 is stopped, the second transistor M2 and the eighth transistor M8 are turned off. At this time, the sixth transistor M6 and the seventh transistor M7 maintain a turn-on state in response to the voltage stored in the first capacitor C1. That is, the second node N2 and the third node N3 maintain the low voltage by the voltage stored in the first capacitor C1.

When the sixth transistor M6 maintains the turn-on state, the output terminal 104 and the third input terminal 103 maintain the electrical connection. When the seventh transistor M7 maintains the turn-on state, the first node N1 maintains the electrical connection with the second input terminal 102. Here, the voltage of the second input terminal 102 is set to a high voltage due to a rising the first clock signal CLK1, and thus the first node N1 is also set to the high voltage. When the high voltage is supplied to the first node N1, the fourth transistor M4 and the fifth transistor M5 are turned off.

Thereafter, the fifth clock signal CLK5 is supplied to the third input terminal 103. At this time, since the sixth transistor M6 is set to a turn-on state, the fifth clock signal CLK5 supplied to the third input terminal 103 is supplied to the output terminal 104. In this case, the output terminal 104 outputs the fifth clock signal CLK5 as the scan signal to the scan line SL1.

Meanwhile, when the fifth clock signal CLK5 is supplied to the output terminal 104, the voltage of the second node N2 is decreased to a voltage lower than that of the second power VGL due to coupling of the first capacitor C1, and thus the sixth transistor M6 stably maintains the turn-on state.

Meanwhile, even though the voltage of the second node N2 is decreased, the third node N3 approximately maintains the voltage of the second power VGL (actually, the voltage obtained by subtracting the threshold voltage of the first transistor M1 from the second power VGL) by the first transistor M1.

After the scan signal is output to the scan line SL1, the supply of the fifth clock signal CLK5 is stopped. When the supply of the fifth clock signal CLK5 is stopped, the output terminal 104 outputs a high voltage.

Thereafter, the first clock signal CLK1 is supplied. When the first clock signal CLK1 is supplied, the second transistor M2 and the eighth transistor M8 are turned on. When the second transistor M2 is turned on, the first input terminal 101 and the third node N3 are electrically connected. At this time, the scan start signal FLM is not supplied to the first input terminal 101 and thus is set to a high voltage. Therefore, when the first transistor M1 is turned on, a high voltage is supplied to the third node N3 and the second node N2, and thus the sixth transistor M6 and the seventh transistor M7 are turned off.

When the eighth transistor M8 is turned on, the second power VGL is supplied to the first node N1, and thus the fourth transistor M4 and the fifth transistor M5 are turned on. When the fifth transistor M5 is turned on, the voltage of the first power VGH is supplied to the output terminal 104. Thereafter, the fourth transistor M4 and the fifth transistor M5 maintain a turn-on state due to the voltage charged in the second capacitor C2, and thus the output terminal 104 stably receives the voltage of the first power VGH.

Additionally, when the fifth clock signal CLK5 is supplied, the third transistor M3 is turned on. At this time, since the fourth transistor M4 is set to a turn-on state, the voltage of the first power VGH is supplied to the third node N3 and the second node N2. In this case, the sixth transistor M6 and the seventh transistor M7 stably maintains the turn-off state.

Thereafter, the first clock signal CLK1 is supplied to the third input terminal 103. At this time, since the sixth transistor M6 is set to the turn-on state, the first clock signal CLK1 supplied to the third input terminal 103 is supplied to the output terminal 104. In this case, the fifth stage ST5 outputs the second scan signal S5 to the fifth scan line SL5 in synchronization with the first clock signal CLK1.

That is, the (4k−3)-th stage may sequentially output the scan signal in a unit of 4 carry stages. For example, the (4k−3)-th stage may sequentially output the first, fifth, ninth, thirteenth, . . . scan signals S1, S5, S9, S13, . . . . Similarly, the (4k−2)-th stage, the (4k−1)-th stage, and the 4k-th stage may sequentially output the scan signal in a unit of 4 carry stages. For example, the (4k−2)-th stage may sequentially output the second, sixth, tenth, fourteenth, . . . scan signals S2, S6, S10, S14, . . . , the (4k−1)-th stage may sequentially output the third, seventh, eleventh, fifteenth, . . . scan signals S3, S7, S11, S15, . . . , and the 4k-th stage may sequentially output the fourth, eighth, twelfth, sixteenth, . . . scan signals S4, S8, S12, S16, . . . .

FIGS. 6 to 15 are diagrams illustrating a first frame period, a second frame period, and a third frame period according to an embodiment of the disclosure.

As the driving frequency of the display device 10 according to an embodiment of the disclosure, any one of the driving frequency may be selected from among a normal frequency and low frequencies lower than the normal frequency. The low frequencies may be frequencies that satisfy Equation 1 below when the normal frequency is F [Hz]. For example, when the normal frequency of the display device 10 is 60 Hz, the low frequencies may be 30 Hz and 15 Hz.

$$\text{Low frequency}=F/2q\ [\text{Hz}]\ (\text{where } q \text{ is a natural number of } 1\leq q\leq p) \quad \text{[Equation 1]}$$

The display device 10 may operate in a first display mode (that is, the driving frequency of 60 Hz) including a plurality of first frame periods FP1, operate in a second display mode (that is, the driving frequency of 30 Hz) including a plurality of second frame periods FP2, or operate in a third display mode (that is, the driving frequency of 15 Hz) including a plurality of third frame periods FP3.

The second frame period FP2 may be longer than the first frame period FP1, and the third frame period FP3 may be longer than the second frame period FP2. For example, the second frame period FP2 may be an integer multiple of the first frame period FP1, and the second frame period FP2 may be 2r (where r may be an integer greater than 0) times the first frame period FP1. In addition, the third frame period FP3 may be an integer multiple of the first frame period FP1, and the third frame period FP3 may be 4r times the first frame period FP1.

In an embodiment of FIG. 6, the second frame period FP2 is 2 times the first frame period FP1, and the third frame period FP3 is 4 times the first frame period FP1. In other words, the third frame period FP3 is 2 times the second frame period FP2.

The first display mode is suitable for displaying a moving picture by displaying the input images (frames) at a high frequency, and the second display mode and the third display mode are suitable for displaying a still image by displaying the input images at a low frequency. When the still image is detected while displaying the moving picture, the display device 10 may switch from the first display mode to the second display mode. In addition, when the moving picture is detected while displaying the still image, the display device 10 may switch from the second display mode to the first display mode.

Meanwhile, the display device 10 may display an image by selecting any one of the second display mode or the third display mode in response to a leakage characteristic of a display panel. Since a flicker phenomenon is reduced as the leakage characteristic of the display panel is improved, the display device 10 may be driven at a lower frequency. For example, when it is determined that the leakage characteristic of the display panel is satisfactory, the display device 10 may display the image in the third display mode, and when it is determined that the leakage characteristic of the display panel is not satisfactory, the display device 10 may display the image in the second display mode.

Referring to FIGS. 3 and 6, for convenience of description, the j-th data line DLj and pixels PX1*j*, PX2*j*, PX3*j*, and PX4*j* are described as a reference. The first pixel PX1*j* according to an embodiment may be connected to the j-th data line and the first scan line SL1. The second pixel PX2*j* according to an embodiment may be connected to the j-th data line and the second scan line SL2. The third pixel PX3*j* according to an embodiment may be connected to the j-th data line and the third scan line SL3. The fourth pixel PX4*j* according to an embodiment may be connected to the j-th data line and the fourth scan line SL4.

In each first frame period FP1, the data driver 12 may sequentially apply data voltages to the data lines corresponding to the scan lines. For example, the data driver 12 may sequentially apply the data voltages DT1, DT2, . . . , DT(m−1), and DTm to the j-th data line DLj. Assuming that the first frame period FP1 is 1/60 second, the first data voltage DT1 may be supplied to the first pixel PX1*j* at 60 Hz. Therefore, the first pixel PX1*j* may emit light with the highest luminance at a time point when the first data voltage DT1 is applied, and then the luminance may be gradually decreased due to a leakage current. Referring to FIG. 6, a luminance waveform of the first pixel PX1*j* corresponding to the plurality of first frame periods FP1 is shown as an example.

Each second frame period FP2 may include a first sub frame period SFP1 and a second sub frame period SFP2. Lengths of the first sub frame period SFP1 and the second sub frame period SFP2 may be the same. For example, assuming that the second frame period FP2 is 1/30 second, each of the first sub frame period SFP1 and the second sub frame period SFP2 may be 1/60 second. For example, in each first sub frame period SFP1, the data driver 12 may sequentially apply data voltages to the data lines corresponding to odd-numbered ((2k−1)-th) pixel rows. The pixel row may mean pixels connected to the same scan line. For example, the data driver 12 may sequentially apply the data voltages DT1, DT3, . . . , and DT(m−1) to the j-th data line DLj. In each second sub frame period SFP2, the data driver 12 may sequentially apply data voltages corresponding to even-numbered ((2k)-th) pixel rows to the data lines. For example, the data driver 12 may sequentially apply the data voltages DT2, DT4, . . . , and DTm to the j-th data line DLj.

Accordingly, the first data voltage DT1 may be supplied to the first pixel PX1*j* at 30 Hz. Therefore, the first pixel PX1*j* may emit light with the highest luminance at a time point when the first data voltage DT1 is applied, and then the luminance may be gradually decreased due to a leakage current. Referring to FIG. 6, a luminance waveform of the first pixel PX1*j* corresponding to the plurality of second frame periods FP2 is shown as an example. In addition, the second data voltage DT2 may be applied to the second pixel PX2*j* at 30 Hz. Therefore, the second pixel PX2*j* may emit light with the highest luminance at a time point when the second data voltage DT2 is applied, and then the luminance may be gradually decreased due to a leakage current. Referring to FIG. 6, a luminance waveform of the second pixel PX2*j* corresponding to the plurality of second frame periods FP2 is shown as an example.

Because the first pixel PX1*j* and the second pixel PX2*j* are disposed adjacent to each other along a column direction, the first data voltage DT1 and the second data voltage DT2 may be generally the same or similar to each other.

Since the time point when the first pixel PX1*j* has the highest luminance and the time point when the second pixel PX2*j* has the highest luminance are alternately disposed, a user may recognize an average luminance waveform AVG as 60 Hz. Accordingly, even though the display mode is switched from the first display mode to the second display mode or from the second display mode to the first display mode, flicker visibility due to a difference of the luminance waveform is prevented.

According to an embodiment, each of the first sub frame period SFP1 and the second sub frame period SFP2 may include a first data blank period BPC1. The first data blank period BPC1 may be periods after the data driver 12 completes supply of the data voltages in each of the first sub frame period SFP1 and the second sub frame period SFP2. During the first data blank period BPC1, the entire or at least a portion of a gamma amp or a digital logic of the data driver 12 may be powered off, and thus power consumption may be reduced.

Each of the third frame period FP3 may include a (1-1)-th sub frame period SFP1-1, a (2-1)-th sub frame period SFP2-1, a third sub frame period SFP3, and a fourth sub frame period SFP4. Lengths of the (1-1)-th sub frame period SFP1-1, the (2-1)-th sub frame period SFP2-1, the third sub frame period SFP3, and the fourth sub frame period SFP4 may be the same. For example, assuming that the third frame period FP3 is 1/15 second, each of the (1-1)-th sub frame period SFP1-1, the (2-1)-th sub frame period SFP2-1, the third sub frame period SFP3, and the fourth sub frame period SFP4 may be 1/60 second.

For example, in each (1-1)-th sub frame period SFP1-1, the data driver 12 may sequentially apply data voltages to the data lines corresponding to a (4k−3)-th pixel row. For example, the data driver 12 may sequentially apply the data voltages DT1, DT5, . . . , and DT(4m−3) to the j-th data line DLj. In each (2-1)-th sub frame period SFP2-1, the data driver 12 may sequentially apply data voltages corresponding to (4k−2)-th pixel row to the data lines. For example, the data driver 12 may sequentially apply the data voltages DT2, DT6, . . . , and DT(4m−2) to the j-th data line DLj. In each third sub frame period SFP3, the data driver 12 may sequentially apply data voltages corresponding to a (4k−1)-th pixel row to the data lines. For example, the data driver 12 may sequentially apply the data voltages DT3, DT7, . . . , and DT(4m−1) to the j-th data line DLj. In each fourth sub frame period SFP4, the data driver 12 may sequentially apply data voltages corresponding to a 4k-th pixel row to the data lines. For example, the data driver 12 may sequentially apply the data voltages DT4, DT8, . . . , and DT(4m−2) to the j-th data line DLj.

Accordingly, the first data voltage DT1 may be supplied to the first pixel PX1*j* at 15 Hz. Therefore, the first pixel PX1*j* may emit light with the highest luminance at a time point when the first data voltage DT1 is applied, and then the luminance may be gradually decreased due to a leakage current. Referring to FIG. 6, a luminance waveform of the first pixel PX1*j* corresponding to the plurality of third frame periods FP3 is shown as an example. The second data voltage DT2 may be applied to the second pixel PX2*j* at 15 Hz. Therefore, the second pixel PX2*j* may emit light with the highest luminance at a time point when the second data voltage DT2 is applied, and then the luminance may be gradually decreased due to a leakage current. Referring to FIG. 6, a luminance waveform of the second pixel PX2*j* corresponding to the plurality of third frame periods FP3 is shown as an example. The third data voltage DT3 may be applied to the third pixel PX3*j* at 15 Hz. Therefore, the third pixel PX3*j* may emit light with the highest luminance at a time point when the third data voltage DT3 is applied, and then the luminance may be gradually decreased due to a leakage current. Referring to FIG. 6, a luminance waveform of the third pixel PX3*j* corresponding to the plurality of third frame periods FP3 is shown as an example. The fourth data voltage DT4 may be applied to the fourth pixel PX4*j* at 15 Hz. Therefore, the fourth pixel PX4*j* may emit light with the highest luminance at a time point when the fourth data voltage DT4 is applied, and then the luminance may be gradually decreased due to a leakage current. Referring to FIG. 6, a luminance waveform of the fourth pixel PX4*j* corresponding to the plurality of third frame periods FP3 is shown as an example.

Because the first pixel PX1*j*, the second pixel PX2*j*, the third pixel PX3*j*, and the fourth pixel PX4*j* are disposed adjacent to each other along the column direction, the first data voltage DT1, the second data voltage DT2, the third data voltage DT3, and the fourth data voltage DT4 may be generally the same or similar to each other.

Since the time point when the first pixel PX1*j* has the highest luminance, the time point when the second pixel PX2*j* has the highest luminance, the time point when the third pixel PX3*j* has the highest luminance, and the time point when the fourth pixel PX4*j* has the highest luminance is successively disposed along the column direction and are repeated every frame, the user may recognize the average luminance waveform AVG of the first pixel PX1*j*, the second pixel PX2*j*, the third pixel PX3*j*, and the fourth pixel PX4*j* as 60 Hz. Accordingly, when the image is displayed in the third display mode, flicker visibility due to the difference of the luminance waveform is prevented while driving at a frequency lower than that of the second display mode.

According to an embodiment, each of the (1-1)-th sub frame period SFP1-1, the (2-1)-th sub frame period SFP2-1, the third sub frame period SFP3, and the fourth sub frame period SFP4 may include a second data blank period BPC2. The second data blank period BPC2 may be a periods after the data driver 12 completes the supply of the data voltages in each of the (1-1)-th sub frame period SFP1-1, the (2-1)-th sub frame period SFP2-1, the third sub frame period SFP3, and the fourth sub frame period SFP4.

Each of the first and second sub frames of the second display mode, the scan driver 13 supplies scan signals to half of the scan lines during one frame. However, each of the first to fourth sub frames of the third display mode, the scan driver 13 supplies one fourth of the scan lines during one frame. Therefore, a scan signal write time for each sub frame in the third display mode may be shorter than a scan signal write time for each sub frame in the second display mode. Thus, the second data blank period BPC2 may be longer than the first blank period BPC1. For example, the scan signal write time for each sub frame in the third display mode may be 0.5 times the scan signal write time for each sub frame in the second display mode, the second data blank period BPC2 may be 1.5 times the first blank period BPC1.

As described above, the display device 10 according to an embodiment of the disclosure may reduce the flicker phenomenon and power consumption even in the third display mode driven at a frequency lower than that of the second display mode.

Figure 7:
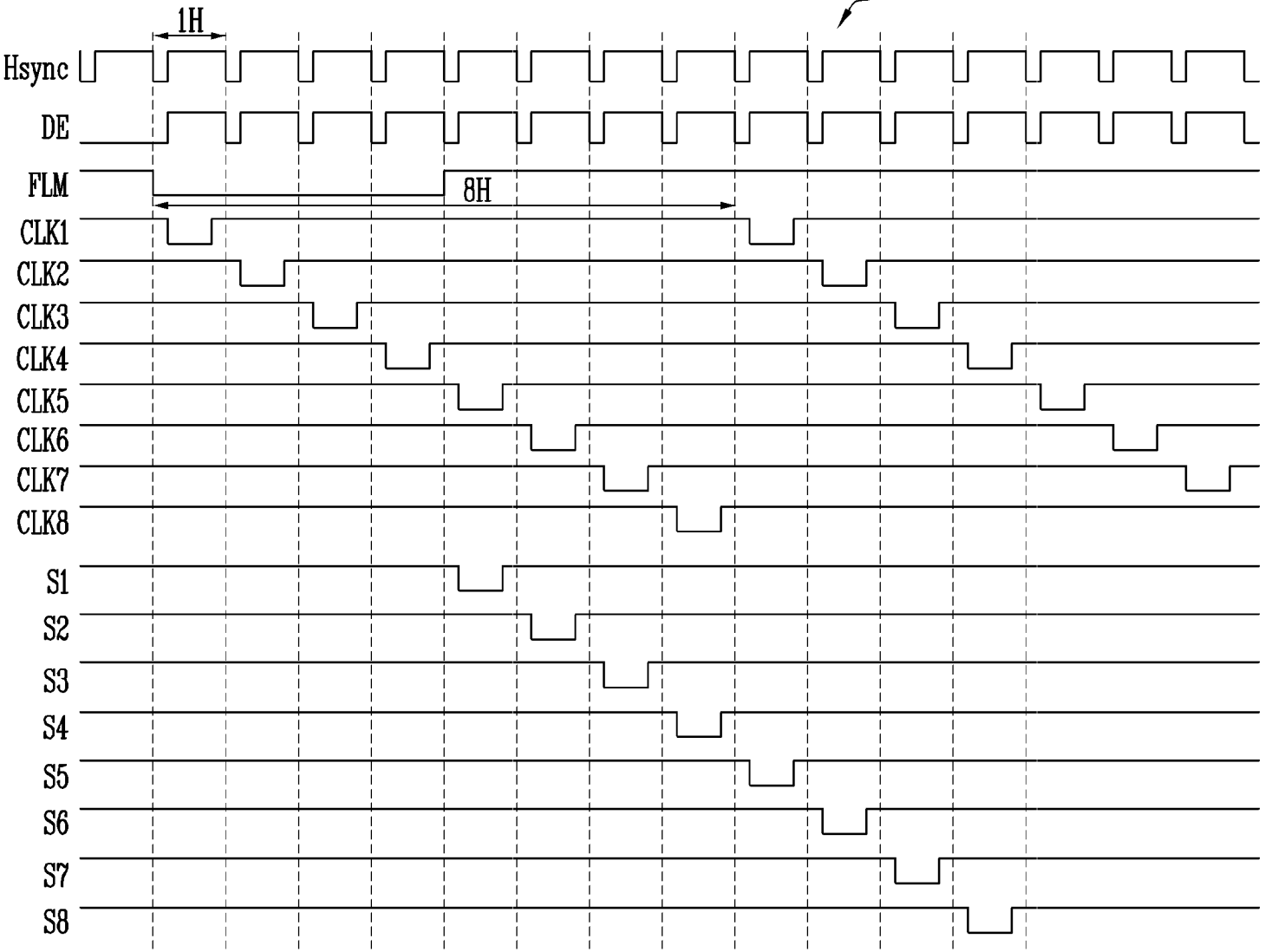

Referring to FIG. 7, control signals in the first frame period FP1 are shown as an example.

During the first frame period FP1, the timing controller 11 may apply the scan start signal FLM of the turn-on level to the scan start line FLML. At this time, a length of the scan start signal FLM of the turn-on level may overlap the first clock signal CLK1 of the turn-on level, the second clock signal CLK2 of the turn-on level, the third clock signal CLK3 of the turn-on level, and the fourth clock signal CLK4 of the turn-on level. For example, the length of the scan start signal FLM of the turn-on level may be four horizontal periods.

In addition, the timing controller 11 may sequentially apply the clock signals CLK1, CLK2, CLK3, CLK4, CLK5, CLK6, CLK7, and CLK8 of the turn-on level to the scan driver 13. For example, each period of the clock signals CLK1, CLK2, CLK3, CLK4, CLK5, CLK6, CLK7, and CLK8 of the turn-on level may be eight horizontal periods. In other words, a clock duty of each clock signals CLK1, CLK2, CLK3, CLK4, CLK5, CLK6, CLK7, and CLK8 is 12.5%. An interval between adjacent pulses of the horizontal synchronization signal Hsync may correspond to one horizontal period.

During the first frame period FP1, the scan driver 13 may be driven in a progressive scanning method. Referring to FIGS. 3 and 7, the scan driver 13 may sequentially apply the scan signals S1, S2, S3, S4, . . . , and S8 of the turn-on level from the first scan line SL1 to the eighth scan line SL8.

Referring to the driving method of FIG. 5, the first scan signal S1 of the turn-on level may be generated in response to the fifth clock signal CLK5 of the turn-on level. In addition, the second scan signal S2 of the turn-on level may be generated in response to the sixth clock signal CLK6 of the turn-on level. Similarly, the third scan signal S3 of the turn-on level may be generated in response to the seventh clock signal CLK7 of the turn-on level. In addition, the fourth scan signal S4 of the turn-on level may be generated in response to the eighth clock signal CLK8 of the turn-on level. In addition, the fifth scan signal S5 of the turn-on level may be generated in response to the first clock signal CLK1 of the turn-on level. In addition, the sixth scan signal S6 of the turn-on level may be generated in response to the second clock signal CLK2 of the turn-on level. In addition, the seventh scan signal S7 of the turn-on level may be generated in response to the third clock signal CLK3 of the turn-on level. In addition, the eighth scan signal S8 of the turn-on level may be generated in response to the fourth clock signal CLK4 of the turn-on level.

The data driver 12 may supply the data voltages in synchronization with each of the scan signals S1, S2, S3, S4, S5, S6, S7, S8, . . . of the turn-on level. For example, the data driver 12 may supply the data voltages in a current horizontal period corresponding to grayscales latched by a data enable signal DE of a logic high level of a previous horizontal period.

Figure 8:
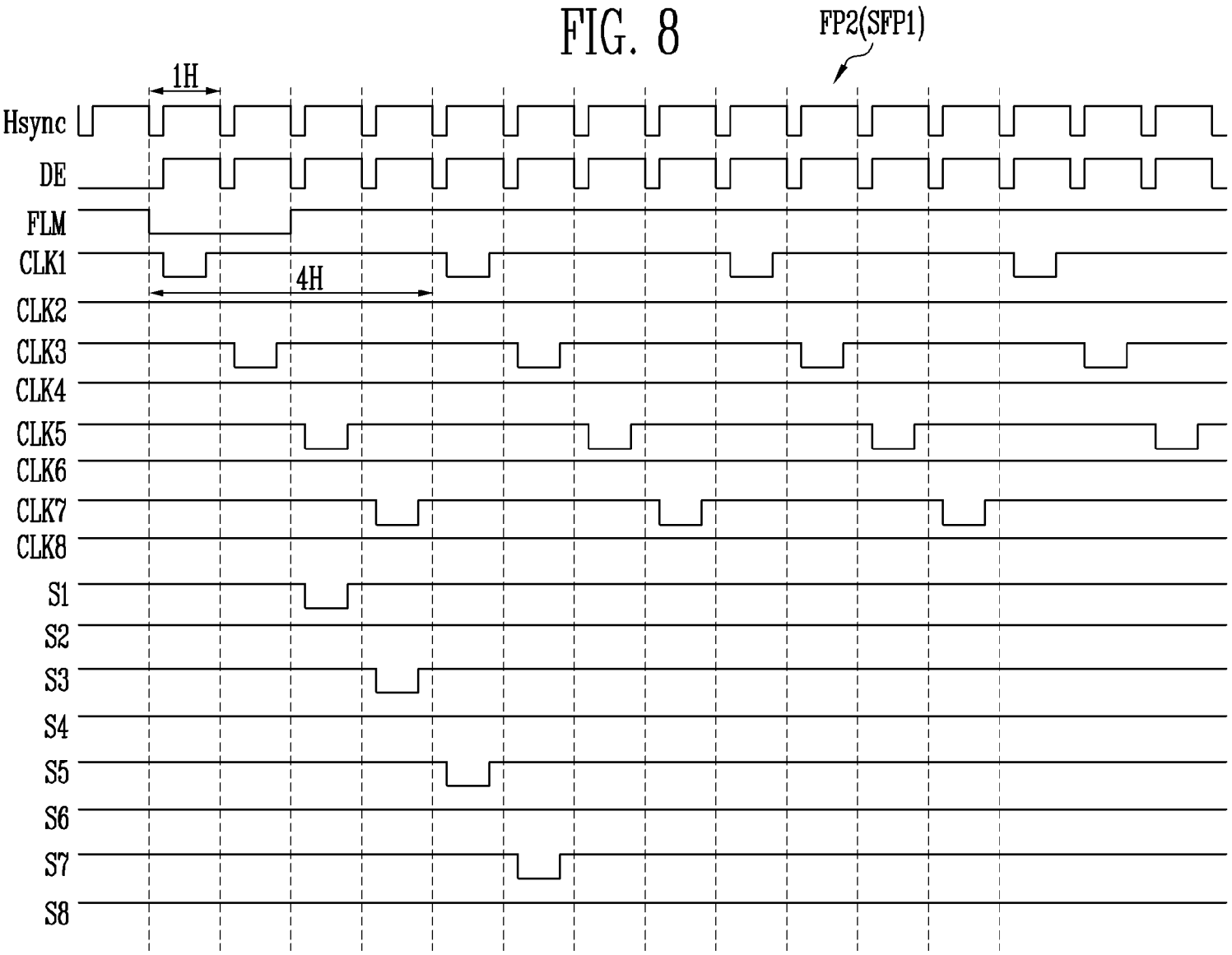

Referring to FIG. 8, control signals in the first sub frame period SFP1 of the second frame period FP2 are shown as an example. Specifically, FIG. 8 illustrates control signals in a period except for the first data blank period BPC1 of the first sub frame period SFP1.

During the first sub frame period SFP1, the timing controller 11 may maintain the second clock signal CLK2, the fourth clock signal CLK4, the sixth clock signal CLK6, and the eighth clock signal CLK8 of a turn-off level, and may sequentially supply the first clock signal CLK1, the third clock signal CLK3, the fifth clock signal CLK5, and the seventh clock signal CLK7 of the turn-on level.

The timing controller 11 may apply the scan start signal FLM of the turn-on level to the scan start line FLML. The length of the scan start signal FLM of the turn-on level may overlap the first clock signal CLK1 of the turn-on level and the third clock signal CLK3 of the turn-on level. For example, the length of the scan start signal FLM of the turn-on level may be two horizontal periods.

In the present embodiment, a period in which each of the clock signals CLK1, CLK3, CLK5, and CLK7 of the turn-on level are respectively applied to the clock signal lines CLKL1, CLKL3, CLKL5, and CLKL7 in the first sub frame period SFP1 may be shorter than a period in which each of the clock signals CLK2 and CLK4 of the turn-on level are respectively applied in the first frame period FP1. For example, each period of the clock signals CLK1, CLK3, CLK5, and CLK7 of the turn-on level may be four horizontal periods. In other words, the clock duty of the clock signals CLK1, CLK3, CLK5, and CLK7 is 25%.

During the first sub frame period SFP1, the scan driver 13 may apply the scan signals S1, S3, S5, S7, . . . of the turn-on level to odd-numbered scan lines SL1, SL3, SL5, SL7, . . . , and may maintain the scan signals S2, S4, S6, S8, . . . of the turn-off level to even-numbered scan lines SL2, SL4, SL6, SL8, . . . . A period in which the scan signals S1, S3, S5, S7, . . . of the turn-on level are applied to the odd-numbered scan lines SL1, SL3, SL5, SL7, . . . in the first sub frame period SFP1 may be shorter than a period in which the odd-numbered scan signals S1, S3, S5, S7, . . . of the turn-on level are applied in the first frame period FP1.

The data driver 12 may supply the data voltages in synchronization with each of the odd-numbered scan signals S1, S3, S5, S7, . . . of the turn-on level.

Figure 9:
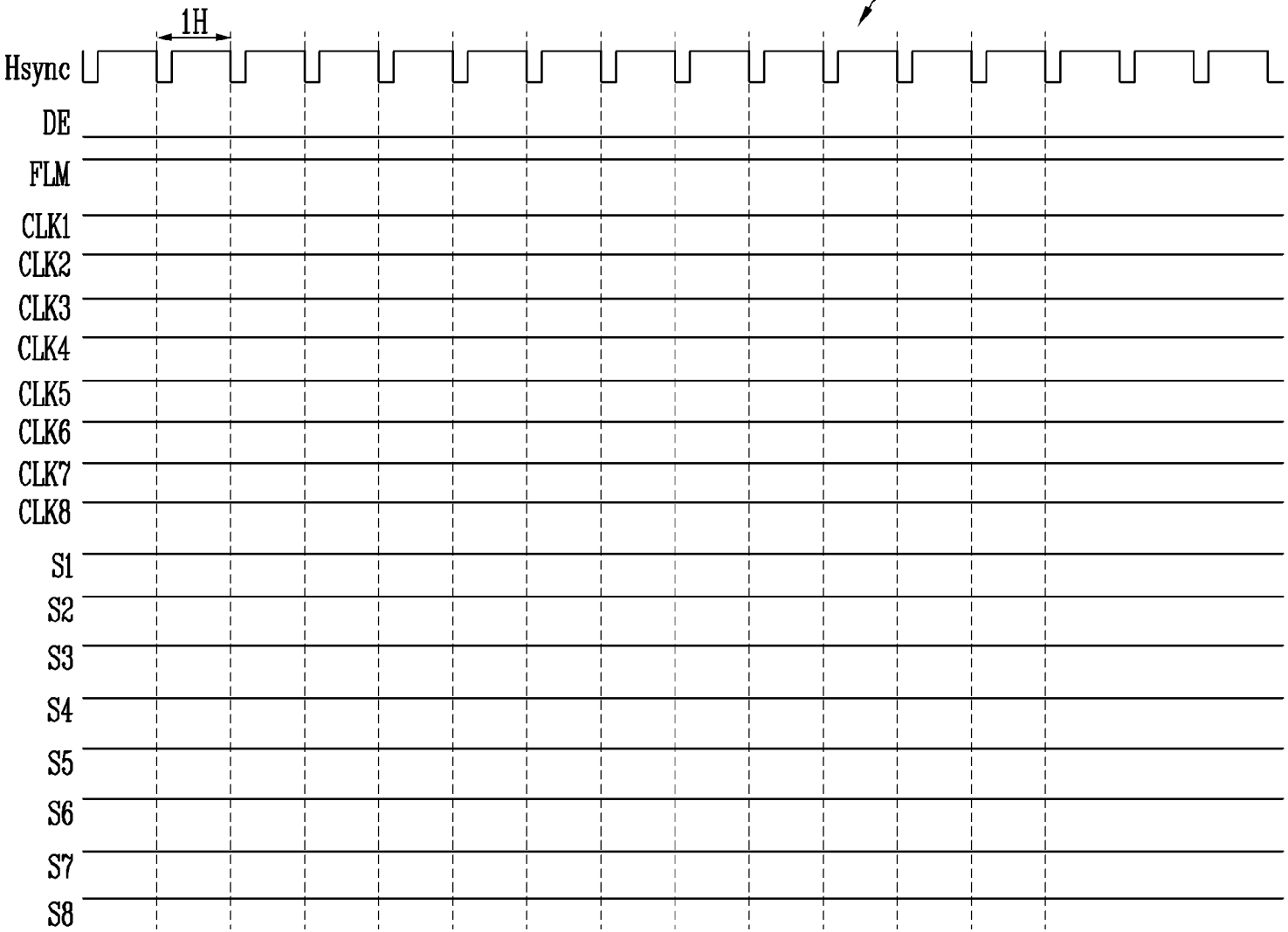

Referring to FIG. 9, control signals in the first data blank period BPC1 of the second frame period FP2 are shown as an example. In the first data blank period BPC1, the clock signals CLK1, CLK2, CLK3, CLK4, CLK5, CLK6, CLK7, and CLK8 of the turn-off level, the scan signals S1, S2, S3, S4, S5, S6, S7, S8, . . . of the turn-off level, and the scan start signal FLM of the turn-off level may be maintained.

As described above, during the first data blank period BPC1, the entire or at least a portion of a gamma amp or a digital logic of the data driver 12 may be powered off, and thus power consumption may be reduced.

Figure 10:
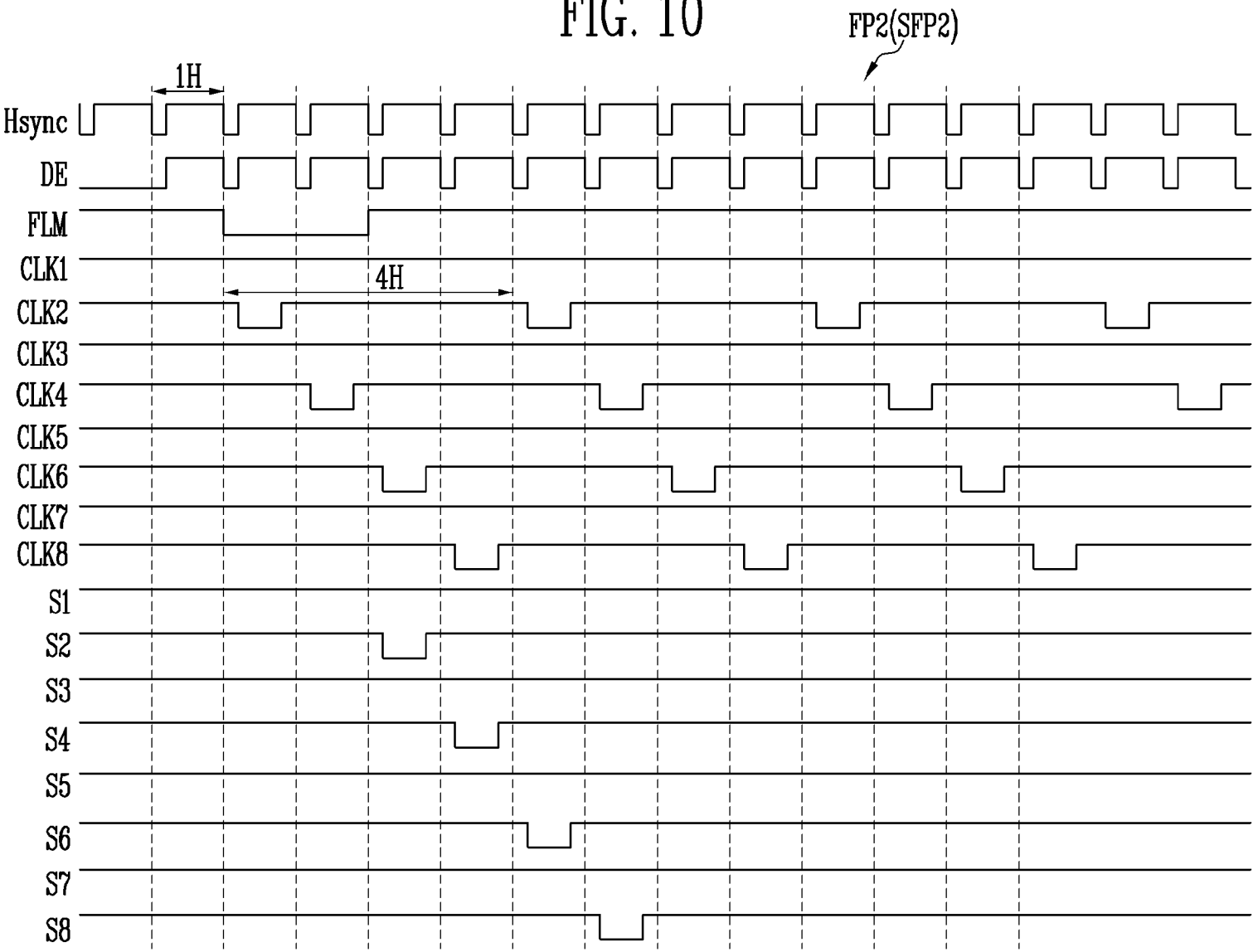

Referring to FIG. 10, control signals in the second sub frame period SFP2 of the second frame period FP2 are shown as an example. Specifically, FIG. 10 illustrates control signals in a period except for the first data blank period BPC1 of the second sub frame period SFP2.

During the second sub frame period SFP2, the timing controller 11 may maintain the first clock signal CLK1, the third clock signal CLK3, the fifth clock signal CLK5, and the seventh clock signal CLK7 of the turn-off level, and may sequentially supply the second clock signal CLK2, the fourth clock signal CLK4, the sixth clock signal CLK6, and the eighth clock signal CLK8 of the turn-on level.

The timing controller 11 may apply the scan start signal FLM of the turn-on level to the scan start line FLML. The length of the scan start signal FLM of the turn-on level may overlap the second clock signal CLK2 of the turn-on level and the fourth clock signal CLK4 of the turn-on level. For example, the length of the scan start signal FLM of the turn-on level may be two horizontal periods.

In the present embodiment, a period in which each of the clock signals CLK2, CLK4, CLK6, and CLK8 of the turn-on level are respectively applied to the clock signal lines CLKL2, CLKL4, CLKL6, and CLKL8 in the second sub frame period SFP2 may be shorter than a period in which each of the clock signals CLK2, CLK4, CLK6, and CLK8 of the turn-on level are respectively applied in the first frame period FP1. For example, each period of the clock signals CLK2, CLK4, CLK6, and CLK8 of the turn-on level may be four horizontal periods. In other words, the clock duty of the clock signals CLK2, CLK4, CLK6, and CLK8 is 25%.

During the second sub frame period SFP2, the scan driver 13 may apply the scan signals S2, S4, S6, S8, . . . of the turn-on level to the even-numbered scan lines SL2, SL4, SL6, SL8, . . . , and maintain the scan signals S1, S3, S5, S7, . . . of the turn-off level to the odd-numbered scan lines SL1, SL3, SL5, SL7, . . . . A period in which the scan signals S2, S4, S6, S8, . . . of the turn-on level are applied to the even-numbered scan lines SL2, SL4, SL6, SL8, . . . in the second sub frame period SFP2 may be shorter than a period in which the even-number scan signals S2, S4, S6, S8, . . . of the turn-on level are applied in the first frame period FP1.

The data driver 12 may supply the data voltages in synchronization with each of the even-numbered scan signals S2, S4, S6, S8, . . . of the turn-on level.

Figure 11:
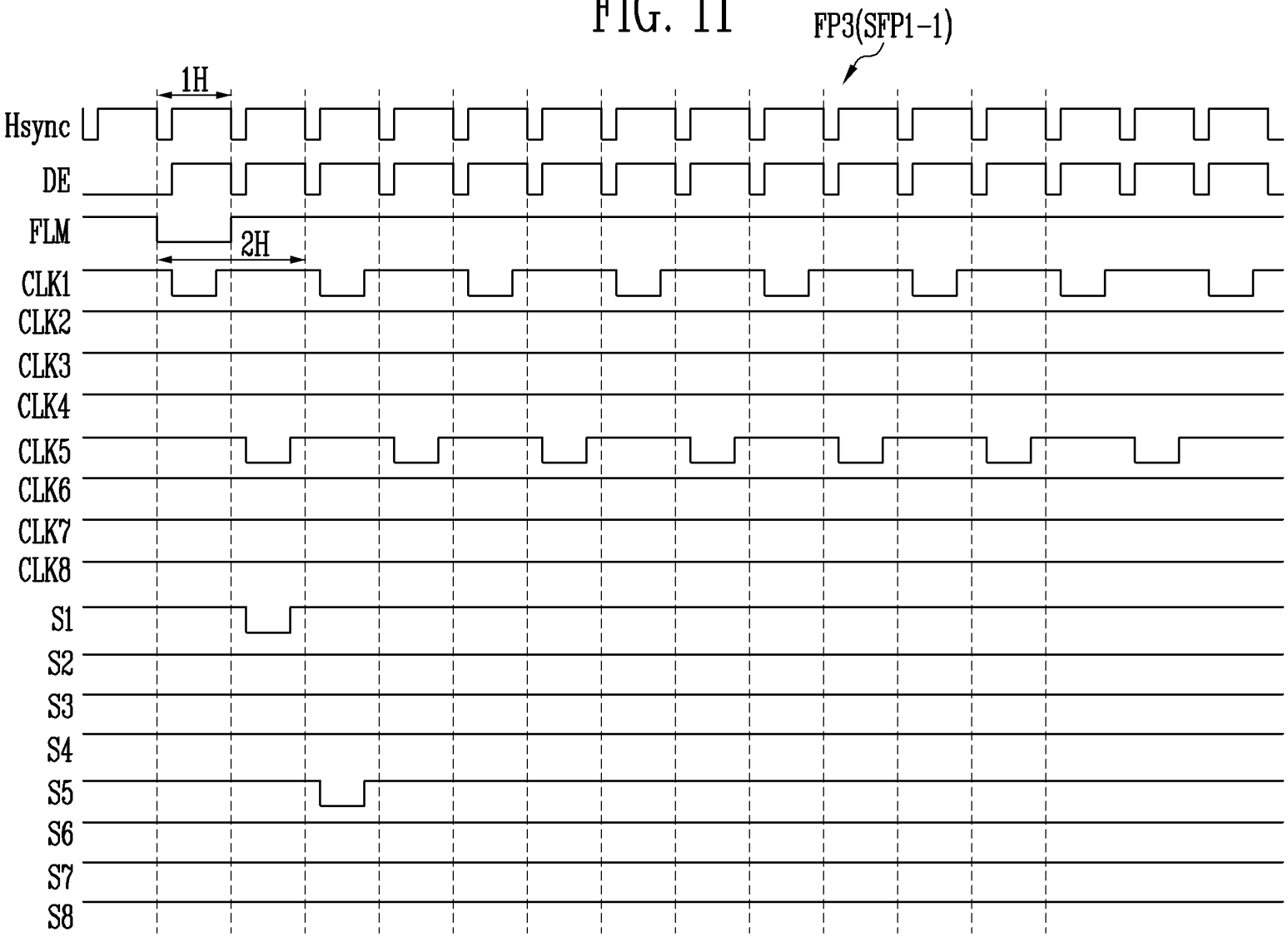

Referring to FIG. 11, control signals in the (1-1)-th sub frame period SFP1-1 of the third frame period FP3 are shown as an example. Specifically, FIG. 11 illustrates control signals in a period except for the second data blank period BPC2 of the (1-1)-th sub frame period SFP1-1.

During the (1-1)-th sub frame period SFP1-1, the timing controller 11 may apply the scan start signal FLM of the turn-on level to the scan start line FLML. The length of the scan start signal FLM of the turn-on level may overlap the first clock signal CLK1 of the turn-on level. For example, the length of the scan start signal FLM of the turn-on level may be one horizontal period.

The timing controller 11 may supply (4k−3)-th clock signals CLK4*k*-3 of the turn-on level, and may supply (4k−2)-th clock signals CLK4*k*-2 of the turn-off level, (4k−1)-th clock signals CLK4*k*-1 of the turn-off level, and 4k-th clock signals CLK4*k* of the turn-off level. For example, the timing controller 11 may sequentially supply the first clock signal CLK1 and the fifth clock signal CLK5 of the turn-on level, and maintain the second clock signal CLK2, the third clock signal CLK5, the fourth clock signal CLK4, the sixth clock signal CLK6, the seventh clock signal CLK7, and the eighth clock signal CLK8 of the turn-off level.

In the present embodiment, a period in which the clock signals CLK1 and CLK5 of the turn-on level are applied to the clock signal lines CLKL1 and CLKL5 in the (1-1)-th sub frame period SFP1-1 may be shorter than a period in which the clock signals CLK1 and CLK5 of the turn-on level are applied in the first sub frame period SFP1 of the first frame period FP1 and the second frame period FP2. For example, each period of the clock signals CLK1 and CLK5 of the turn-on level may be two horizontal periods. In other words, the clock duty of the clock signals CLK1 and CLK5 is 50%.

During the (1-1)-th sub frame period SFP1-1, the scan driver 13 may apply the scan signals S1, S5, S9, S13, . . . of the turn-on level to (4k−3)-th scan lines SL1, SL5, SL9, SL13, . . . , maintain the scan signals S2, S6, S10, S14, . . . of the turn-off level to (4k−2)-th scan lines SL2, SL6, SL10, SL14, . . . , maintain the scan signals S3, S7, S11, S15, . . . of the turn-off level to (4k−1)-th scan lines SL3, SL7, SL11, SL15, . . . , and maintain the S4, S8, S12, S16, . . . of the turn-off level to 4k-th scan lines SL4, SL8, SL12, SL16, . . . .

A period in which the scan signals S1, S5, S9, S13, . . . of the turn-on level are applied to the (4k−3)-th scan lines SL1, SL5, SL9, SL13, . . . in the (1-1)-th sub frame period SFP1-1 may be shorter than a period in which the scan signals S1, S5, S9, S13, . . . of the turn-on level are applied in the first sub frame period SFP1 of the first frame period FP1 and the second frame period FP2.

Referring to FIG. 6, the period in which the scan signals S1, S5, S9, S13, . . . of the turn-on level are applied to the (4k−3)-th scan lines SL1, SL5, SL9, SL13, . . . in the (1-1)-th sub frame period SFP1-1 is 0.25 times of the period in which the scan signals S1, S5, S9, S13, . . . of the turn-on level are applied to the (4k−3)-th scan lines SL1, SL5, SL9, SL13, . . . in the first frame period FP1, and is 0.5 times of the period in which the scan signals S1, S5, S9, S13, . . . of the turn-on level are applied to the (4k−3)-th scan lines SL1, SL5, SL9, SL13, . . . in the first sub frame period SFP1.

The data driver 12 may supply the data voltages in synchronization with each of the (4k−3)-th scan signals S1, S5, S9, S13, . . . of the turn-on level.

Figure 12:
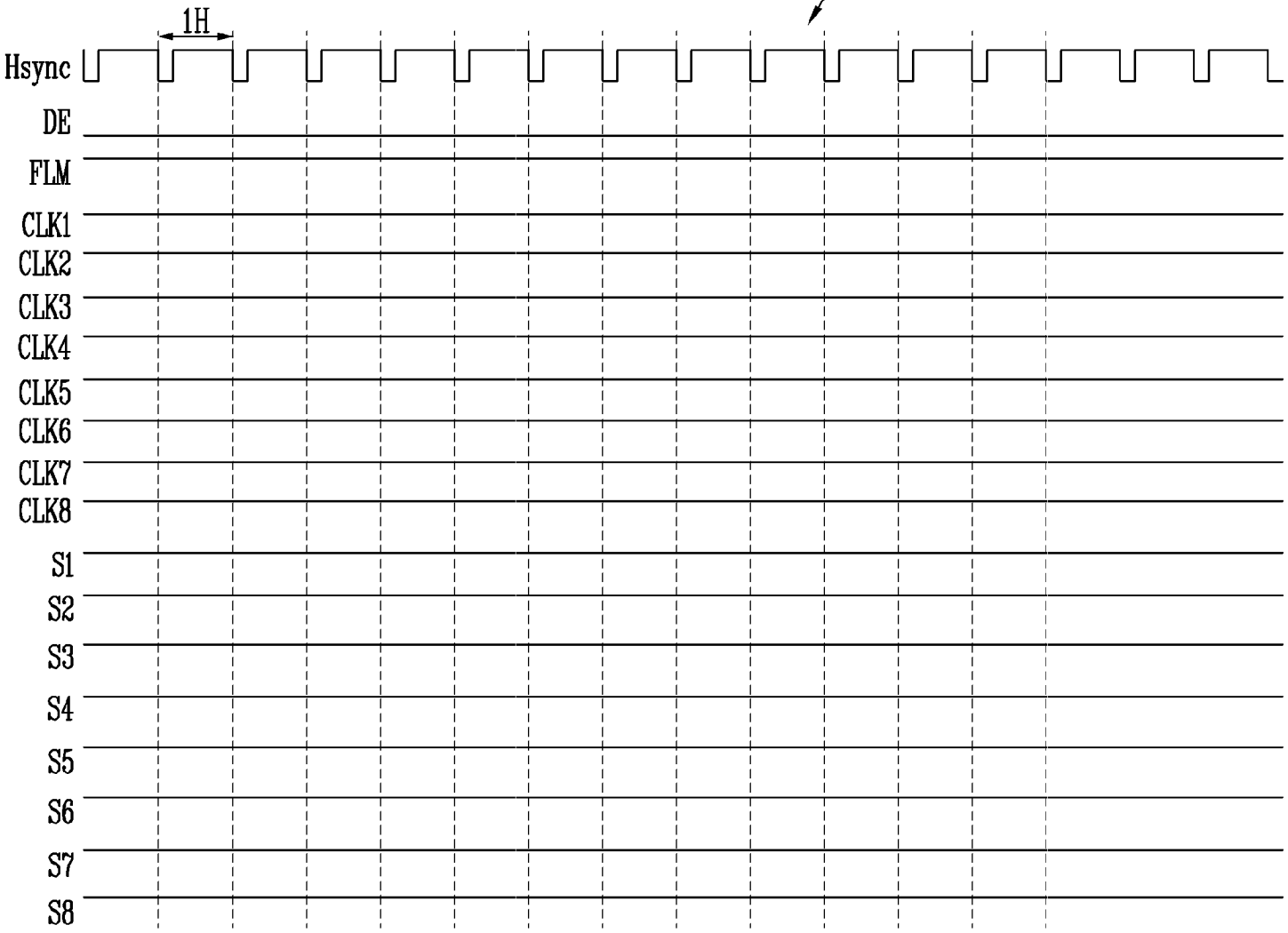

Referring to FIG. 12, control signals in the second data blank period BPC2 of the third frame period FP3 are shown as an example. In the second data blank period BPC2, the data enable signal DE of the turn-off level, the clock signals CLK1, CLK2, CLK3, CLK4, CLK5, CLK6, CLK7, and CLK8 of the turn-off level, the scan signals S1, S2, S3, S4, S5, S6, S7, S8, . . . of the turn-off level, and the scan start signal FLM of the turn-off level may be maintained.

As described above, the second data blank period BPC2 may be longer than the first blank period BPC1. Since the period in which the scan signals S1, S5, S9, S13 . . . of the turn-on level are applied to the (4k−3)-th scan lines SL1, SL5, SL9, SL13, . . . in the (1-1)-th sub frame period SFP1-1 is decreased to half of the period in which the scan signals S1, S5, S9, S13 . . . of the turn-on level are applied to the (4k−3)-th scan lines SL1, SL5, SL9, SL13, . . . in the first sub frame period SFP1. The second data blank period BPC2, which is a period after the supply of the data voltages is completed, may increase 1.5 times as compared to the first blank period BPC1.

Figure 13:
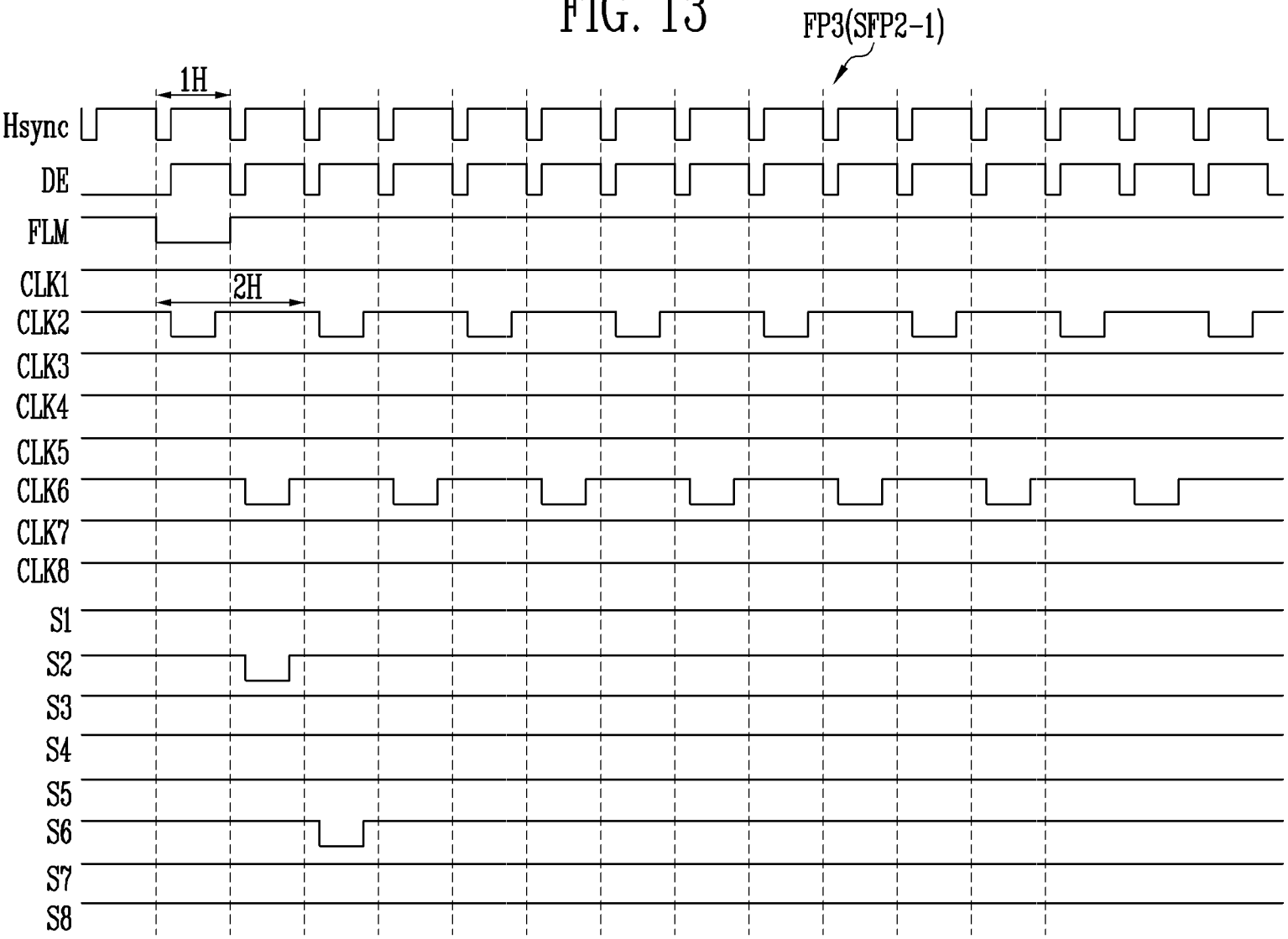

Referring to FIG. 13, control signals in the (2-1)-th sub frame period SFP2-1 of the third frame period FP3 are shown as an example. Specifically, FIG. 13 illustrates the control signals in a period except for the second data blank period BPC2 of the (2-1)-th sub frame period SFP2-1.

During the (2-1)-th sub frame period SFP2-1, the timing controller 11 may apply the scan start signal FLM of the turn-on level to the scan start line FLML. The length of the scan start signal FLM of the turn-on level may overlap the second clock signal CLK2 of the turn-on level. For example, the length of the scan start signal FLM of the turn-on level may be one horizontal period.

The timing controller 11 may supply the (4k−2)-th clock signals CLK4*k*-2 of the turn-on level, and supply the (4k−3)-th clock signals CLK4*k*-3 of the turn-off level, the (4k−1)-th clock signals CLK4*k*-1 of the turn-off level, and the 4k-th clock signals CLK4*k* of the turn-off level. For example, the timing controller 11 may sequentially supply the second clock signal CLK2 and the sixth clock signal CLK6 of the turn-on level, and maintain the first clock signal CLK1, the third clock signal CLK3, the fourth clock signal CLK4, the fifth clock signal CLK5, the seventh clock signal CLK7, and the eighth clock signal CLK8 of the turn-off level.

In the present embodiment, a period in which the clock signals CLK2 and CLK6 of the turn-on level are applied to the clock signal lines CLKL2 and CLKL6 in the (2-1)-th sub frame period SFP2-1 may be shorter than a period in which the clock signals CLK2 and CLK6 of the turn-on level are applied in the first sub frame period SFP1 of the first frame period FP1 and the second frame period FP2. For example, each period of the clock signals CLK2 and CLK6 of the turn-on level may be two horizontal periods. In other words, the clock duty of the clock signals CLK2 and CLK6 is 50%.

A period in which the scan signals S2, S6, S10, S14, . . . of the turn-on level are applied to the (4k−2)-th scan lines SL2, SL6, SL10, SL14, . . . in the (2-1)-th sub frame period SFP2-1 may be shorter than a period in which the scan signals S2, S6, S10, S14, . . . of the turn-on level are applied to the (4k−2)-th scan lines SL2, SL6, SL10, SL14, . . . in the first sub frame period SFP1 of the first frame period FP1 and the second frame period FP2.

The data driver 12 may supply the data voltages in synchronization with 78

Figure 14:
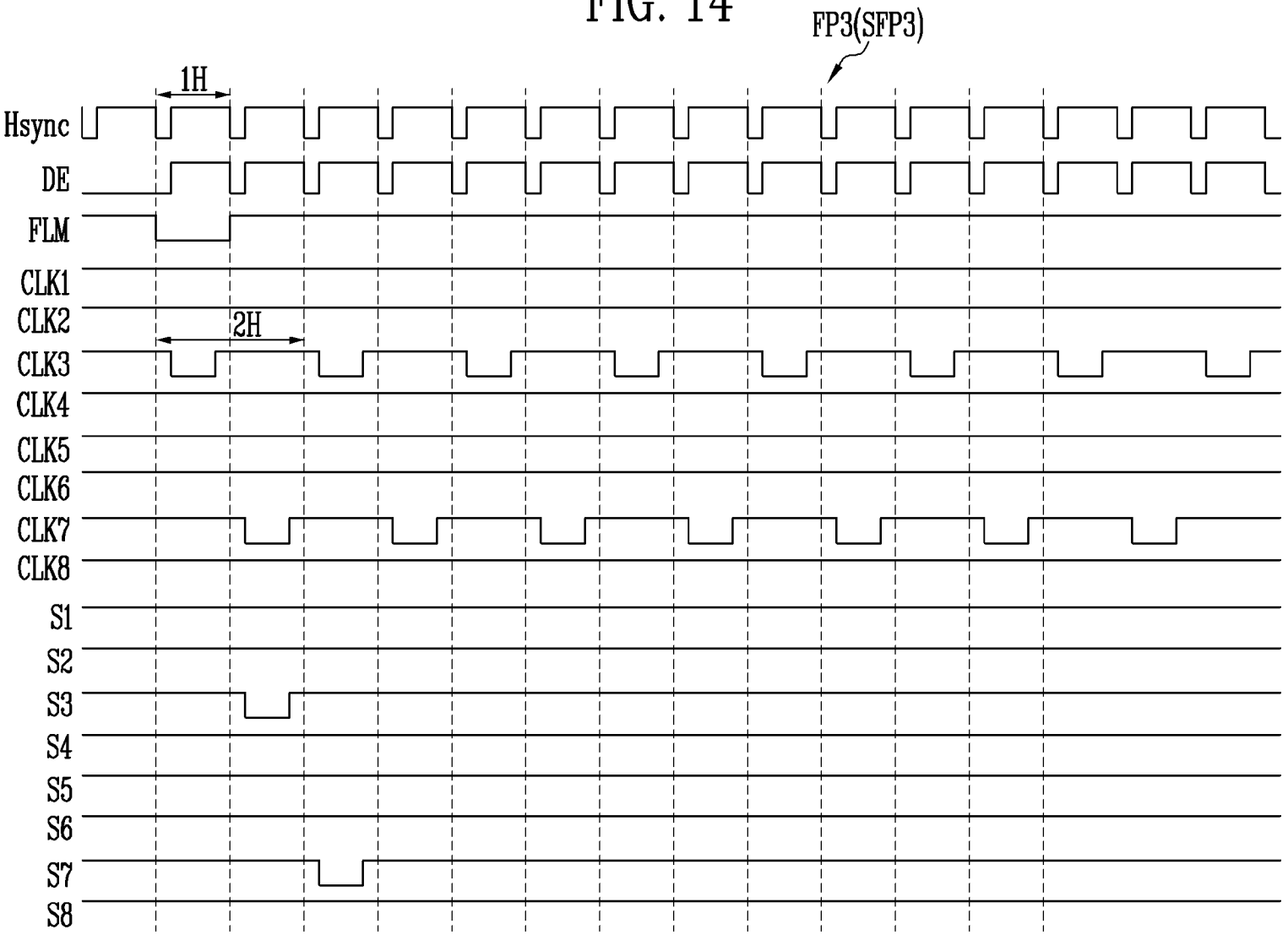

Referring to FIG. 14, control signals in the third sub frame period SFP3 of the third frame period FP3 are shown as an example. Specifically, FIG. 14 illustrates control signals in a period except for the second data blank period BPC2 of the third sub frame period SFP3.

During the third sub frame period SFP3, the timing controller 11 may apply the scan start signal FLM of the turn-on level to the scan start line FLML. The length of the scan start signal FLM of the turn-on level may overlap the third clock signal CLK3 of the turn-on level. For example, the length of the scan start signal FLM of the turn-on level may be one horizontal period.

The timing controller 11 may supply the (4k−1)-th clock signals CLK4*k*-1 of the turn-on level, and supply the (4k−3)-th clock signals CLK4*k*-3 of the turn-off level, the (4k−2)-th clock signals CLK4*k*-2 of the turn-off level, and the 4k-th clock signals CLK4*k* of the turn-off level. For example, the timing controller 11 may sequentially supply the third clock signal CLK3 and the seventh clock signal CLK7 of the turn-on level, and maintain the first clock signal CLK1, the second clock signal CLK2, the fourth clock signal CLK4, the fifth clock signal CLK5, the sixth clock signal CLK6, and the eighth clock signal CLK8 of the turn-off level.

In the present embodiment, a period in which the clock signals CLK3 and CLK7 of the turn-on level are applied to the clock signal lines CLKL3 and CLKL7 in the third sub frame period SFP3 may be shorter than a period in which the clock signals CLK3 and CLK7 of the turn-on level are applied in the first sub frame period SFP1 of the first frame period FP1 and the second frame period FP2. For example, each period of the clock signals CLK3 and CLK7 of the turn-on level may be two horizontal periods. In other words, the clock duty of the clock signals CLK3 and CLK7 is 50%.

A period in which the scan signals S3, S7, S11, S15, . . . of the turn-on level are applied to the (4k−1)-th scan lines SL3, SL7, SL11, SL15, . . . in the third sub frame period SFP3 may be shorter than a period in which the scan signals S3, S7, S11, S15, . . . of the turn-on level are applied to the (4k−1)-th scan lines SL3, SL7, SL11, SL15 of the turn-on level in the first sub frame period SFP1 of the first frame period FP1 and the second frame period FP2.

The data driver 12 may supply the data voltages in synchronization with each of the (4k−1)-th scan signals S3, S7, S11, S15, . . . of the turn-on level.

Figure 15:
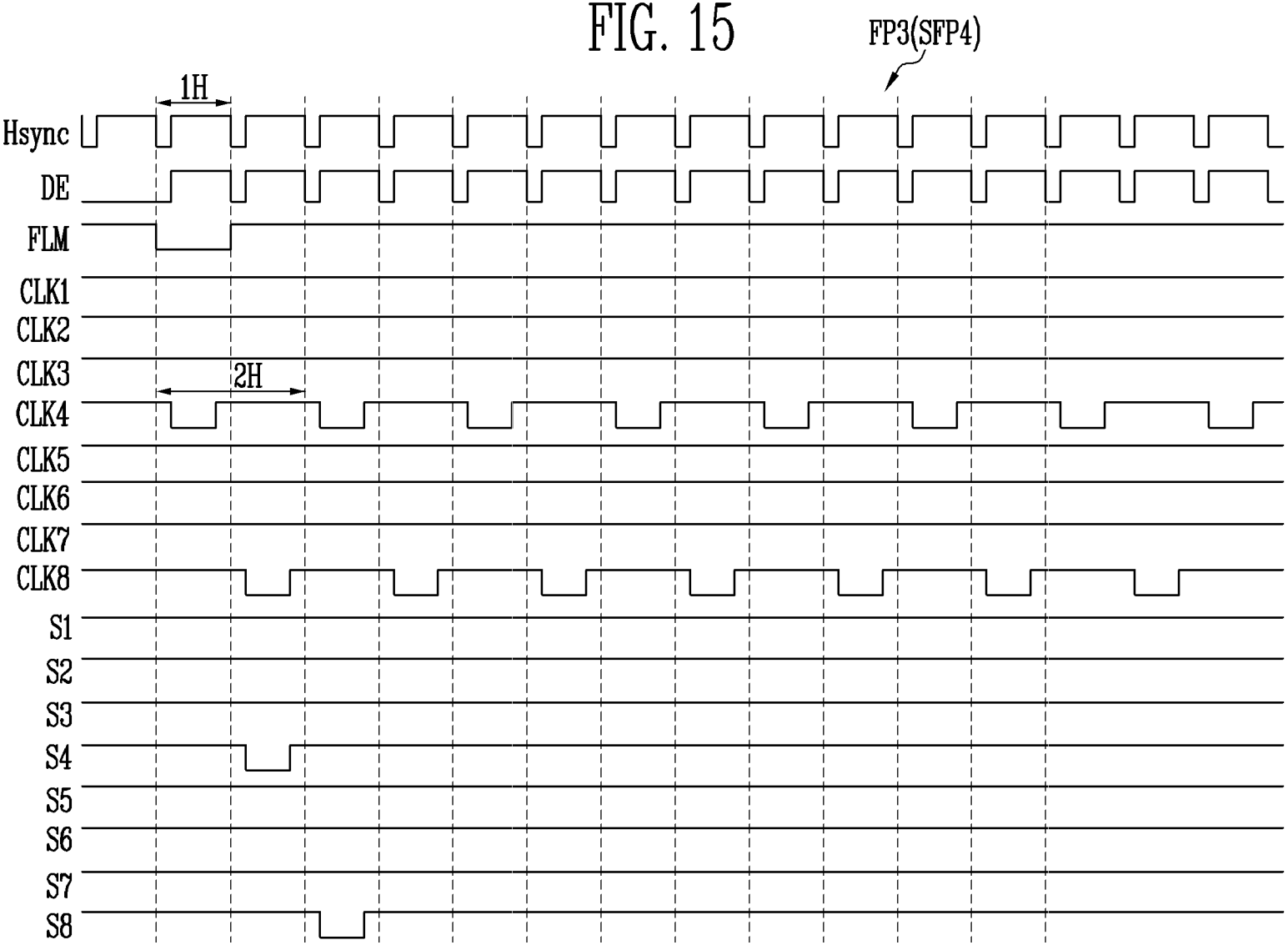

Referring to FIG. 15, control signals in the fourth sub frame period SFP4 of the third frame period FP3 are shown as an example. Specifically, FIG. 15 illustrates control signals in a period except for the second data blank period BPC2 of the fourth sub frame period SFP4.

During the fourth sub frame period SFP4, the timing controller 11 may apply the scan start signal FLM of the turn-on level to the scan start line FLML. The length of the scan start signal FLM of the turn-on level may overlap the fourth clock signal CLK4 of the turn-on level. For example, the length of the scan start signal FLM of the turn-on level may be one horizontal period.

The timing controller 11 may supply the 4k-th clock signals CLK4*k* of the turn-on level, and supply the (4k−3)-th clock signals CLK4*k*-3 of the turn-off level, the (4k−2)-th clock signals CLK4*k*-2 of the turn-off level, and the (4k−1)-th clock signals CLK4*k*-1 of the turn-off level. For example, the timing controller 11 may sequentially supply the fourth clock signal CLK4 and the eighth clock signal CLK8 of the turn-on level, and maintain the first clock signal CLK1, the second clock signal CLK2, the third clock signal CLK3, the fifth clock signal CLK5, the sixth clock signal CLK6, and the seventh clock signal CLK7 of the turn-off level.

In the present embodiment, a period in which the clock signals CLK4 and CLK8 of the turn-on level are applied to the clock signal lines CLKL4 and CLKL8 in the fourth sub frame period SFP4 may be shorter than a period in which the clock signals CLK4 and CLK8 of the turn-on level are applied to the clock signal lines CLKL4 and CLKL8 in the first sub frame period SFP1 of the first frame period FP1 and the second frame period FP2. For example, each period of the clock signals CLK4 and CLK8 of the turn-on level may be two horizontal periods. In other words, the clock duty of the clock signals CLK4 and CLK8 is 50%.

A period in which the scan signals S4, S8, S12, S16, . . . of the turn-on level are applied to the 4k-th scan lines SL4, SL8, SL12, SL16, . . . in the fourth sub frame period SFP4 may be shorter than a period in which the scan signals S4, S8, S12, S16, . . . of the turn-on level are applied to the 4k-th scan lines SL4, SL8, SL12, SL16, . . . of the turn-on level in the first sub frame period SFP1 of the first frame period FP1 and the second frame period FP2.

The data driver 12 may supply the data voltages in synchronization with each of the 4k-th scan signals S4, S8, S12, S16, . . . of the turn-on level.

The foregoing detailed description illustrates and describes the disclosure. In addition, the foregoing description merely shows and describes preferred embodiments of the disclosure, as described above, the disclosure may be used in various other combinations, modifications, and environments, and the disclosure may be changed or modified within the scope of the concept of the disclosure disclosed in this specification, the scope equivalent to the disclosed disclosure, and/or the skill or knowledge in the art. Accordingly, the detailed description of the disclosure is not intended to limit the disclosure to the disclosed embodiments. Also, the appended claims should be construed as including other embodiments.

What is claimed is:

1. A display device comprising:

a timing controller configured to receive input image data and output a plurality of clock signals, a scan start signal, and image data;

a scan driver including a plurality of stages connected to a plurality of clock signal lines to which the plurality of clock signals are provided and generating a plurality of scan signals in response to the scan start signal;

a data driver configured to generate a plurality of data signals based on the image data; and a pixel portion including a plurality of pixels, each of the plurality of pixels emitting light with luminance corresponding to a respective data signal in response to a respective scan signal, wherein one stage in the scan driver transmits a carry signal to $2^n$-th next stage (n is a natural number greater than or equal to 2), and wherein the timing controller selects any one of a normal frequency and low frequencies lower than the normal frequency as a driving frequency based on the input image data, and adjusts a clock duty of the plurality of clock signals so that a time required to output all of the plurality of scan signals during one frame is constant irrespective of the driving frequency.

2. The display device according to claim 1, wherein when the unit of the stages to which the carry signal is transmitted is $2^n$, the number of clock signal lines is $2^{n+1}$.

3. The display device according to claim 1, wherein when the normal frequency is F [Hz], the low frequencies include a frequency that satisfies Equation 1 below, $$\text{Low frequency}=F/2m\ [\text{Hz}]\ (\text{where } m \text{ is a natural number of } 1\leq m\leq n). \quad \text{[Equation 1]}$$

4. The display device according to claim 1, wherein, when grayscale values of the input image data corresponding to each of consecutive frames are substantially the same, the timing controller selects any one of the low frequencies as the driving frequency, and wherein, when the gray scale values of the input image data corresponding to each of the consecutive frames are substantially different, the timing controller selects the normal frequency as the driving frequency.

5. The display device according to claim 1, wherein when the driving frequency decreases by ½ times, the clock duty increases by 2 times.

6. The display device according to claim 1, wherein, when the number of the clock signal lines is eight, the driving frequency includes the normal frequency, a first low frequency, and a second low frequency lower than the first low frequency.

7. The display device according to claim 6, wherein, when the driving frequency is selected as the normal frequency, the plurality of stages sequentially output the plurality of scan signals during one frame.

8. The display device according to claim 6, wherein, when the driving frequency is selected as the first low frequency, the plurality of stages output an odd number of scan signals corresponding to a (2k−1)-th (k is a natural number greater than or equal to 1) pixel row among the plurality of scan signals during a first sub frame, and output an even number of scan signals corresponding to a 2k-th (k is a natural number greater than or equal to 1) pixel row among the plurality of scan signals during a second sub frame.

9. The display device according to claim 8, wherein each of the first and second sub frames includes a first data blank period in which the plurality of clock signals have a turn-off level.

10. The display device according to claim 9, wherein, when the driving frequency is selected as the second low frequency, the plurality of stages output scan signals of a first group corresponding to a (4k−3)-th (k is a natural number greater than 1) pixel row among the plurality of scan signals during a (1-1)-th sub frame, output scan signals of a second group corresponding to a (4k−2)-th (k is a natural number greater than 1) pixel row among the plurality of scan signals during a (2-1)-th sub frame, output scan signals of a third group corresponding to a (4k−1)-th (k is a natural number greater than 1) pixel row among the plurality of scan signals during a third sub frame, and output scan signals of a fourth group corresponding to a 4k-th (k is a natural number greater than 1) pixel row among the plurality of scan signals during a fourth sub frame.

11. The display device according to claim 10, wherein each of the (1-1)-th sub frame, the (2-1)-th sub frame, the third sub frame, and the fourth sub frame includes a second data blank period in which the plurality of clock signals have the turn-off level.

12. The display device according to claim 11, wherein a length of the second data blank period is longer than a length of the first data blank period.

13. A method of driving a display device comprising a timing controller configured to receive input image data and output a plurality of clock signals, a scan start signal, and image data, a scan driver including a plurality of stages connected to a plurality of clock signal lines to which the plurality of clock signals are provided and generating a plurality of scan signals in response to the scan start signal, a data driver configured to generate a plurality of data signals based on the image data, and a pixel portion including a plurality of pixels, each of the plurality of pixels emitting light with luminance corresponding to a respective data signal in response to a respective scan signal, the method comprising:

selecting any one of a normal frequency and low frequencies lower than the normal frequency as a driving frequency based on the input image data; and adjusting a clock duty of the plurality of clock signals so that a time required to output all of the plurality of scan signals during one frame is constant irrespective of the driving frequency.

14. The method according to claim 13, wherein one stage in the scan driver transmits a carry signal to $2^{n\text{-}th}$ next stage (n is a natural number greater than or equal to 2) stages, and wherein the number of clock signal lines is $2^{n+1}$.

15. The method according to claim 13, wherein selecting the driving frequency comprises:

selecting any one of the low frequencies as the driving frequency when grayscale values of the input image data corresponding to each of consecutive frames are substantially the same; and selecting the normal frequency as the driving frequency when the grayscale values of the input image data corresponding to each of the consecutive frames are substantially different.

16. The method according to claim 13, wherein adjusting the clock duty comprises increasing the clock duty by 2 times when the driving frequency decreases by ½ times.

17. The method according to claim 13, wherein, when the number of the plurality of clock signal lines is eight, the driving frequency includes the normal frequency, a first low frequency, and a second low frequency lower than the first low frequency.

18. The method according to claim 17, wherein, when the driving frequency is selected as the normal frequency, the plurality of stages sequentially output the plurality of scan signals during one frame.

19. The method according to claim 17, wherein, when the driving frequency is selected as the first low frequency, the plurality of stages output an odd number of scan signals corresponding to a (2k−1)-th (k is a natural number greater than or equal to 1) pixel row among the plurality of scan signals during a first sub frame, and output an even number of scan signals corresponding to a 2k-th (k is a natural number greater than or equal to 1) pixel row among the plurality of scan signals during a second sub frame.

20. The method according to claim 19, wherein each of the first and second sub frames includes a first data blank period in which the plurality of clock signals have a turn-off level.

21. The method according to claim 20, wherein, when the driving frequency is selected as the second low frequency, the plurality of stages output scan signals of a first group corresponding to a (4k−3)-th (k is a natural number greater than 1) pixel row among the plurality of scan signals during a (1-1)-th sub frame, output scan signals of a second group corresponding to a (4k−2)-th (k is a natural number greater than 1) pixel row among the plurality of scan signals during a (2-1)-th sub frame, output scan signals of a third group corresponding to a (4k−1)-th (k is a natural number greater than 1) pixel row among the plurality of scan signals during a third sub frame, and output scan signals of a fourth group corresponding to a 4k-th (k is a natural number greater than 1) pixel row among the plurality of scan signals during a fourth sub frame.

22. The method according to claim 21, wherein each of the (1-1)-th sub frame, the (2-1)-th sub frame, the third sub frame, and the fourth sub frame includes a second data blank period in which the plurality of clock signals have the turn-off level.

23. The method according to claim 22, wherein a length of the second data blank period is longer than a length of the first data blank period.

* * * * *